US007604913B2

(12) United States Patent
Tajima et al.

(10) Patent No.: US 7,604,913 B2
(45) Date of Patent: Oct. 20, 2009

(54) ELECTROPHOTOGRAPHIC PHOTOSENSITIVE BODY

(75) Inventors: Hiroyuki Tajima, Yokohama (JP); Yuuta Kumano, Yokohama (JP)

(73) Assignee: Mitsubishi Chemical Corporation, Tokyo (JP)

( * ) Notice: Subject to any disclaimer, the term of this patent is extended or adjusted under 35 U.S.C. 154(b) by 89 days.

(21) Appl. No.: 11/572,001

(22) PCT Filed: Jul. 15, 2005

(86) PCT No.: PCT/JP2005/013187

§ 371 (c)(1),
(2), (4) Date: Jan. 12, 2007

(87) PCT Pub. No.: WO2006/009126

PCT Pub. Date: Jan. 26, 2006

(65) Prior Publication Data

US 2008/0063963 A1 Mar. 13, 2008

(30) Foreign Application Priority Data

Jul. 16, 2004 (JP) ..... 2004-210571

(51) Int. Cl.
*G03G 5/04* (2006.01)

(52) U.S. Cl. ..... 430/59.6; 430/58.7; 399/159

(58) Field of Classification Search ..... 430/58.7, 430/59.6

See application file for complete search history.

(56) References Cited

U.S. PATENT DOCUMENTS

| | | | | |
|---|---|---|---|---|
| 4,284,699 | A | 8/1981 | Berwick et al. | |
| 5,804,344 | A | 9/1998 | Mitsumori | |
| 6,030,734 | A | 2/2000 | Mitsumori | |
| 2001/0049067 | A1 * | 12/2001 | Mitsumori et al. | 430/58.8 |

FOREIGN PATENT DOCUMENTS

| | | | |
|---|---|---|---|
| EP | 2238 A | * | 6/1979 |
| JP | 50-98332 | | 8/1975 |
| JP | 56-135844 | | 10/1981 |
| JP | 59-071057 | | 4/1984 |
| JP | 59-184251 | | 10/1984 |
| JP | 03-006567 | | 1/1991 |
| JP | 05-346671 | | 12/1993 |
| JP | 08-234468 | * | 9/1996 |
| JP | 9-244278 | | 9/1997 |
| JP | 10-20514 | * | 1/1998 |
| JP | 10-020514 | * | 1/1998 |
| JP | 10-288845 | | 10/1998 |
| JP | 2001-265022 | * | 9/2001 |
| JP | 2002-275133 | | 9/2002 |
| JP | 2002-333731 | * | 11/2002 |

OTHER PUBLICATIONS

Machine translation of Japanese patent publication JP 10-020514 published Jan. 23, 1998 by Yoshida, Akira.*
Machine translation of Japanese patent publication JP 2001-265022 published Sep. 28, 2001 by Mimori, Mitsusachi.*
Diamond, "Handbook of Imaging Materials," Mercel Dekker, NY, NY. 1991. p. 160-162.*
English translation of JP 08-234468 published Sep. 1996.*
U.S. Appl. No. 12/189,929, filed Aug. 12, 2008, Kumano.

* cited by examiner

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

Disclosed is an electrophotographic photoreceptor which is excellent in wear resistance and electrical characteristics. Specifically disclosed is an electrophotographic photoreceptor containing a polyester resin in a photosensitive layer provided on an electroconductive substrate. The polyester resin is composed of a copolymer represented by the general formula 1 below, which has a viscosity average molecular weight (Mv) of 10,000-300,000 and contains a diphenyl ether 4,4'-dicarboxylic acid component and a bivalent phenol component.

[Chemical Formula 1]

$$-(A\text{-}B)_n- \quad (1)$$

In the general formula 1, A represents a diphenyl ether 4,4'-dicarboxylic acid residue represented by the formula A below, and B represents a bivalent phenol residue represented by the formula B below.

[Chemical formula 2]

(A)

(B)

In the formula A, each of $Ra^1$ and $Ra^2$ independently represents a hydrogen atom or a monovalent substituent which may have a substituent, and each of n and m is independently an integer from 0 to 4. In the formula B, each of $R^1$ and $R^2$ independently represents one selected from the group consisting of a hydrogen atom, an alkyl group, an aryl group, a halogen group, and an alkoxy group.

13 Claims, 1 Drawing Sheet

ELECTROPHOTOGRAPHIC PHOTOSENSITIVE BODY

TECHNICAL FIELD

The present invention relates to an electrophotographic photoreceptor, and more in detail to an electrophotographic photoreceptor having high wear resistance and the like.

BACKGROUND ART

Electrophotographic technology is used in a wide variety of fields including a copier, various kinds of printers and the like because it can quickly provide high quality photographic images. A photoreceptor using an organic photoconductive material which has advantages of no pollution, easy film forming, easy production, and the like is used for the photoreceptor which serves as a core of the electrophotographic technology.

As the photoreceptor using the organic photoconductive material, two types are known. One is a so called dispersion type photoreceptor using a fine powder photoconductive material which is dispersed in a binder resin. The other is a so called lamination type photoreceptor into which a charge generation layer and a charge transport layer are laminated. Particularly, the lamination type photoreceptor is the mainstream of the photoreceptor, is enthusiastically developed, and is put into practice, because it allows a highly sensitive photoreceptor to be obtained by combining the charge generation material and the charge transport material which respectively have a high efficiency of generating and transporting electric charges, because it offers such a wide selection of materials as to allow the obtaining of safe and secure materials, because it allows a photosensitive layer to be easily formed by means of application thereof, and also because it provides high productivity and advantage in cost reduction.

The electrophotographic photoreceptor is repeatedly used in an electrophotographic process, that is, in cycles of charging, exposing, developing, transporting, cleaning, and charge removal. Thus, it is subjected to such various stresses to be deteriorated during this cycle. These deteriorations include chemical and electrical ones such as, for example, chemical damages on the photosensitive layer caused by strong oxidizing ozone and NOx generated from a corona charger which is usually used as a charging device, and the decomposition of a composition in the photosensitive layer due to the flow of the carrier (electric current) generated in the photosensitive layer by exposing the image, the charge removal light, or the external light. Furthermore, there are mechanical deteriorations including the occurrence of wear and scratches on the surface of the photosensitive layer, and the peeling off of the film, due to the sliding abrasions of a cleaning blade and a magnetic blush therewith, and due to its contact with a developing agent and a paper. In particular, the damages generated on the surface of the photosensitive layer tend to appear on the image, and thereby directly diminish an image quality. Thus, they are the major factors which limit the service lifetime of the photoreceptor.

In the case of a general photoreceptor which is not provided with a functional layer such as a surface protecting layer, the photosensitive layer is subjected to these loads. The photosensitive layer is usually constituted of a binder resin and a photoconductive material. Its strength is substantially influenced by the binder resin. However, the amount of doped photoconductive material is considerably so large that the photosensitive layer has not been allowed to have the sufficient mechanical strength. Moreover, the increasing need for a high speed printing requires a material corresponding to a higher speed electrophotographic process. In this case, the photoreceptor must have a better quick response because of the need for shortening a period of time from exposure to development, as well as high sensitivity and a long service lifetime.

Each of the layers constituting the electrophotographic photoreceptor is usually formed by coating with a coating liquid containing a photoconductive material and a binder resin on a base support by means of dip-coating, spray coating, nozzle coating, bar coating, roll coating, blade coating. As these methods of forming a layer, well known methods are employed in which a coating solution obtained by dissolving the materials to be contained in the layer in a solvent is applied. For many processes, a coating solution is previously prepared, and is then stored.

As the binder resin of the photosensitive layer, thermoplastic resin and various kinds of thermosetting resins, including vinyl polymers such as poly(methyl methacrylate), polystyrene, and poly(vinyl chloride), and copolymers thereof, polycarbonate, polyester, polysulfone, phenoxy, epoxy, silicon resin. Among a large number of binder resins, the polycarbonate resin has relatively excellent performance. Thus, various kinds of polycarbonate resins have so far been developed and thus put into practice (refer to Patent Documents 1 to 4).

On the other hand, it has been reported that the electrophotographic photoreceptor, in which a polyarylate resin commercially available under the trade name of "U-polymer" is used as a binder, has a further improved sensitivity, compared to one using the polycarbonate (refer to Patent Document 5). Moreover, it has been reported that the use of the polyarylate resin, in which a bivalent phenol component having a particular structure as a binder resin improves the stability of a coating solution used when producing an electrophotographic photoreceptor, and in which the component further improves mechanical strength and wear resistance of the electrophotographic photoreceptor (refer to Patent Documents 6 and 7).

Patent Document 1: Japanese Laid-open Patent Application No. 50-098332

Patent Document 2: Japanese Laid-open Patent Application No. 59-071057

Patent Document 3: Japanese Laid-open Patent Application No. 59-184251

Patent Document 4: Japanese Laid-open Patent Application No. 05-021478

Patent Document 5: Japanese Laid-open Patent Application No. 56-135844

Patent Document 6: Japanese Laid-open Patent Application No. 03-006567

Patent Document 7: Japanese Laid-open Patent Application No. 10-288845

DISCLOSURE OF THE INVENTION

Problems to be Solved by the Invention

As aforementioned, the conventional electrophotographic photoreceptor has the problems of the occurrence of the wear and scratches on the surface of electrophotographic photoreceptor due to practical loads such as development using a toner, abrasion with paper, and abrasion with the cleaning member (blade), and therefore at present has a limited printing performance in practical use.

The electrophotographic photoreceptors using the binder resin which has so far been known have an improved mechanical strength, but insufficient electrical characteristics. In addition, many of the coating liquids for forming a photosensitive layer prepared by dissolving the above binder resin in suitable solvent are poor in solution stability, and therefore become clouded to form precipitates, thereby resulting in the occurrence of the problem of insolubilization of the binder resin.

The present invention was made to solve such problems. That is, it is an object of the present invention to provide an electrophotographic photoreceptor which has an excellent wear resistance to practical loads, excellent electrical properties while keeping a high mechanical strength, and contains a binder resin providing high stability of a coating solution for forming photosensitive layer.

Means for Solving the Problems

As a result of enthusiastic studies, the present inventors found that it is possible to obtain an electrophotographic photoreceptor having adequate mechanical properties, high solubility in a solvent used for a coating solution for forming a photosensitive layer, the excellent stability of the coating solution, and excellent electrical properties by causing a photosensitive layer to contain polyester resin having a particular chemical structure, and the inventors finally completed the present invention based on such a finding.

That is, according to the present invention, an electrophotographic photoreceptor is provided, the electrophotographic photoreceptor consisting of an electroconductive substrate, photosensitive layers provided on the electroconductive substrate, which contains a polyester resin having at least one of the repeating units represented by the following general formulae 1 to 5.

[Chemical Formula 1]

$$-(A\text{-}B)_n- \quad (1)$$

[Chemical Formula 2]

$$-(A\text{-}C)_n- \quad (2)$$

[Chemical Formula 3]

$$-(A\text{-}D)_n- \quad (3)$$

[Chemical Formula 4]

$$-(A\text{-}E)_n- \quad (4)$$

[Chemical Formula 5]

$$-[(A\text{-}F)_a(G\text{-}F)_b]_n- \quad (5)$$

(In the general formula 5, $\{a/(a+b)\}>0.7$.)

In the general formulae 1 to 5, A is a compound having the structure represented by the following formula A.

[Chemical formula 6]

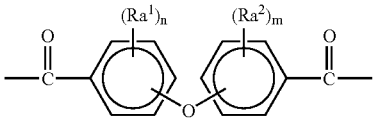

(A)

(In formula A, $Ra^1$ and $Ra^2$ are independently a hydrogen atom or a monovalent substituent which may have a substituent, and n and m are independently one of integers 0 to 4.)

(In formula 1, B is a compound having the structure represented by the following formula B.)

[Chemical formula 7]

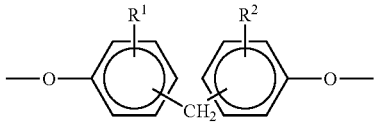

(B)

(In formula B, $R^1$ and $R^2$ are independently a hydrogen atom, an alkyl group, an aryl group, a halogen group, or an alkoxy group.)

In formula 2, C is a compound having the structure represented by the following formula C.

[Chemical formula 8]

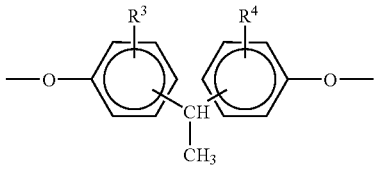

(C)

(In formula C, $R^3$ and $R^4$ are independently a hydrogen atom, an alkyl group, an aryl group, a halogen group, or an alkoxy group.)

In formula 3, D is a compound having the structure represented by the following formula D.

[Chemical formula 9]

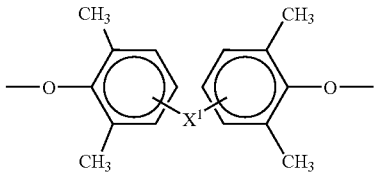

(D)

(In Formula D, $X^1$ is a Single Bond or a Bivalent Group.)

In formula 4, E is a compound having the structure represented by the following formula E.

[Chemical formula 10]

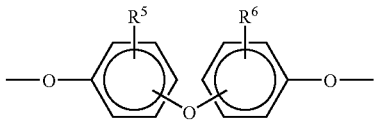

(E)

(In formula E, $R^5$ and $R^6$ are independently a hydrogen atom, an alkyl group, an aryl group, a halogen group, or an alkoxy group.)

In formula 5, F is a compound having the structure represented by the following formula F.

[Chemical formula 11]

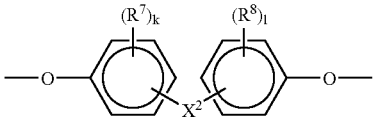

(F)

(In formula F, $X^2$ is a single bond or a bivalent group. $R^7$ and $R^8$ are independently a hydrogen atom, an alkyl group, an aryl group, a halogen group, or an alkoxy group. k and l are independently one of integers 1 to 4.)

In formula 5, G is a compound having the structure represented by the following formula G.

[Chemical formula 12]

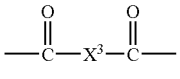

(G)

(In Formula G, $X^3$ is a Bivalent Group.)

ADVANTAGES OF THE INVENTION

According to the present invention, an electrophotographic photoreceptor having excellent wear resistance and the like can be obtained.

BEST MODES FOR CARRYING OUT THE INVENTION

The best mode for carrying out the present invention (hereinafter, referred to as embodiments of the present invention) will be described below in detail. The present invention is not limited to the following embodiments, but various modifications may be carried out within the scope of the present invention.

The electrophotographic photoreceptor to which the present embodiment is applied is provided with a photosensitive layer which is provided on a predetermined electroconductive substrate, and which contains at least one of polyester resins having the repeating units represented by the aforementioned general formulae 1 to 5. Specific constructions of the photosensitive layers include, for example, a lamination type photoreceptor which is formed by stacking a charge generation layer consisting primarily of a charge generating material and a charge transport layer consisting primarily of a charge transporting material and a binder resin on an electroconductive substrate; and dispersion type (single layer type) a photoreceptor having a photosensitive layer which contains a charge generating material dispersed in a layer containing a charge transporting material and a binder resin, on an electroconductive substrate. The polyester resins having the repeating units represented by one of the above general formulae 1 to 5 are usually used for a layer containing a charge transporting material, and preferably used for a charge transport layer of the lamination type photosensitive layer.

(Electroconductive Substrate)

Materials for an electroconductive substrate used in the electrophotographic photoreceptor to which the present embodiment is applied may include, for example: metallic materials such as aluminum, aluminum alloy, stainless steel, copper, and nickel; resin materials provided with an electric conductivity by adding an electroconductive powder such as a metal, carbon, tin oxide; and a resin, glass and paper having an electroconductive material such as aluminum, nickel, and ITO (indium-tin oxide) being vapor deposited or coated on a surface of the electroconductive substrate.

Forms of the electroconductive substrate may be, such as drum form, sheet form, and belt form. Alternatively, an electroconductive substrate made of a metallic material may also be used, on which an electroconductive material having suitable resistance value is coated for controlling the electric conductivity and the surface properties or for covering the defects. When using a metallic material such as an aluminum alloy as an electroconductive substrate, an anodizing treatment and a chemical film treatment may previously be applied thereto. When carrying out an anodizing treatment, it is desirably subjected to a sealing treatment carried out by a known method.

The surface of the electroconductive substrate may be smooth and may be caused to be coarse by means of a special cutting method, grinding treatment, or by mixing particles having a suitable particle size with the material constructing the electroconductive substrate.

As the specific construction of the photosensitive layer used in the electrophotographic photoreceptor to which the present embodiment is applied, for example, in the case of a lamination type a photoreceptor, the photosensitive layer includes a charge transport layer which contains a charge transporting material and a binder resin, and which holds electrostatic charges to transport charges generated by exposure, and a charge generation layer which contains a charge generating material so as to generate a charge pair by exposure. In addition to the above layers, a charge blocking layer and a light diffusing layer may be included in some cases as necessary, the charge blocking layer preventing charge injection from the electroconductive substrate, the light diffusing layer diffusing light such as laser beam to prevent an interference pattern from occurring. In a case of the dispersed type (single layer type) photoreceptor, a charge transporting material and a charge generating material are dispersed in a binder resin in a photosensitive layer thereof.

(Polyester Resin)

Next, a binder resin being contained in the photosensitive layer will be described.

At least one of polyester resins having the repeating units represented by the following general formulae 1 to 5 is contained as the binder resin in the photosensitive layer used in the electrophotographic photoreceptor to which the present embodiment is applied.

The viscosity-average molecular weight (Mv) of polyester resins having repeating units represented by one of the general formulae 1 to 5 is not particularly limited, and is usually 10,000 or more, is preferably 15,000 or more, and is more preferably 20,000 or more. However, the viscosity-average molecular weight (Mv) is usually 300,000 or less, is preferably 200,000 or less, and is more preferably 100,000 or less. If the viscosity-average molecular weight thereof is excessively low, the mechanical strength of the polyester resin is reduced thus being unpractical. If the viscosity-average molecular weight thereof is excessively high, it becomes difficult to coat the photosensitive layer in a suitable thickness.

[Chemical Formula 13]

$$-(A\text{-}B)_n- \quad (1)$$

In the general formulae 1 to 5, A represents a compound having dicarboxylic acid residue, which is represented by the following formula A, in the molecule.

[Chemical formula 14]

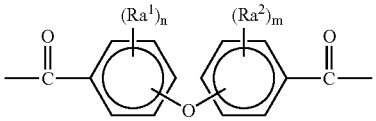

(A)

Here, in the formula A, each of $Ra^1$ and $Ra^2$ which are independent of one another represents a monovalent substituent which may have a hydrogen atom or a substituent. Each of n and m which are independent of one another is an integer from 0 to 4. Monovalent substituent for $Ra^1$ or $Ra^2$, may be, for example, an alkyl group having a carbon number of 1 to 8; aryl group such as phenyl group, and naphthyl group; halogen group such as a fluorine atom, a chlorine atom, a bromine atom, and iodine atom; alkoxy group such as methoxy group, ethoxy group, and a butoxy group. In view of the solubility in a coating liquid to form a photosensitive layer as a binder resin for a photosensitive layer, an alkyl group among these groups is preferable, an alkyl group having a carbon number of 1 to 8 is more preferable, and an alkyl group having a carbon number of 1 to 2 is further preferable. Each of n and m which are independent of each other, is an integer from 0 to 4, and particularly preferably n=m=0.

The specific examples of the dicarboxylic acid residue represented by formula A include diphenyl ether 2,2'-dicarboxylic acid residue, diphenyl ether 2,3'-dicarboxylic acid residue, diphenyl ether 2,4'-dicarboxylic acid residue, diphenyl ether 3,3'-dicarboxylic acid residue, diphenyl ether 3,4'-dicarboxylic acid residue, and diphenyl ether 4,4'-dicarboxylic acid residue. In view of the convenience in producing dicarboxylic acid component, diphenyl ether 2,2'-dicarboxylic acid residue, diphenyl ether 2,4'-dicarboxylic acid residue, diphenyl ether 4,4'-dicarboxylic acid residue among these are preferable, and diphenyl ether 4,4'-dicarboxylic acid residue is particularly preferable.

A plurality of these compounds exemplified as the diphenyl ether dicarboxylic acid residue A can be used in combination with one another as necessary.

In the general formula 1, B represents a compound having a bivalent phenol residue represented by the following formula B in the molecule.

[Chemical formula 15]

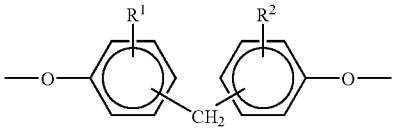

(B)

In formula B, each of $R^1$ and $R^2$ which are independent of one another represents a hydrogen atom, an alkyl group, an aryl group, a halogen group, or an alkoxy group. In view of mechanical properties required of the binder resin for the photosensitive layer, and solubility in a solvent in preparing a coating liquid for forming the photosensitive layer, a phenyl group and a naphthyl group are preferable for the aryl group, a fluorine atom, a chlorine atom, a bromine atom, and an iodine atom are preferable for the halogen group, and a methoxy group, an ethoxy group, and a butoxy group are preferable for the alkoxy group. For the alkyl group, an alkyl group having a carbon number of 1 to 10 is preferable, an alkyl group having a carbon number of 1 to 8 is more preferable, and an alkyl group having a carbon number of 1 to 2 is further preferable.

The specific examples of the bivalent phenol compounds which serve as the bivalent phenol residue represented by formula B include, for example bis(2-hydroxyphenyl)methane, (2-hydroxyphenyl)(3-hydroxyphenyl)methane, (2-hydroxyphenyl)(4-hydroxyphenyl)methane, bis(3-hydroxyphenyl)methane, (3-hydroxyphenyl)(4-hydroxyphenyl)methane, bis(4-hydroxyphenyl)methane, bis(2-hydroxy-3-methylphenyl)methane, bis(2-hydroxy-3-ethylphenyl)methane, (2-hydroxy-3-methylphenyl)(3-hydroxy-4-methylphenyl)methane, (2-hydroxy-3-ethylphenyl)(3-hydroxy-4-ethylphenyl)methane, (2-hydroxy-3-methylphenyl)(4-hydroxy-3-methylphenyl)methane, (2-hydroxy-3-ethylphenyl)(4-hydroxy-3-ethylphenyl)methane, bis(3-hydroxy-4-methylphenyl)methane, bis(3-hydroxy-4-ethylphenyl)methane, (3-hydroxy-4-methylphenyl)(4-hydroxy-3-methylphenyl)methane, (3-hydroxy-4-ethylphenyl)(4-hydroxy-3-ethylphenyl)methane, bis(4-hydroxy-3-methylphenyl)methane, bis(4-hydroxy-3-ethylphenyl)methane.

In view of the convenience in producing the bivalent phenol compound which serve as the bivalent phenol residue, bis(4-hydroxyphenyl)methane, (2-hydroxyphenyl)(4-hydroxyphenyl)methane, bis(2-hydroxyphenyl)methane, bis(4-hydroxy-3-methylphenyl)methane, and bis(4-hydroxy-3-ethylphenyl)methane among them are particularly preferable. A plurality of these components can be used in combination with one another as necessary.

[Chemical Formula 16]

$$-(A\text{-}C)_n- \quad (2)$$

In the general formula 2, C represents a compound having the bivalent phenol residue represented by the following formula C in the molecule.

[Chemical formula 17]

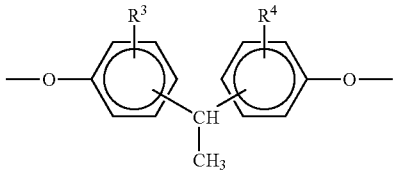

(C)

In formula C, each of $R^3$ and $R^4$ which are independent of each other is a hydrogen atom, an alkyl group, an aryl group, a halogen group, or an alkoxy group. In view of mechanical properties required of the binder resin for the photosensitive layer, and of solubility in a solvent used in preparing a coating liquid for forming the photosensitive layer, a phenyl group and a naphthyl group are preferable for the aryl group, a fluorine atom, a chlorine atom, a bromine atom, and an iodine atom are preferable for the halogen group, and a methoxy group, an ethoxy group, and a butoxy group are preferable for the alkoxy group. For the alkyl group, an alkyl group having a carbon number of 1 to 10 is preferable, an alkyl group having a carbon number of 1 to 8 is more preferably, and an alkyl group having a carbon number of 1 to 2 is further preferable.

The specific examples of a bivalent phenol compound which serve as the bivalent phenol residue represented by formula C include, for example, 1,1-bis(2-hydroxyphenyl) ethane, 1-(2-hydroxyphenyl)-1-(3-hydroxyphenyl)ethane, 1-(2-hydroxyphenyl)-1-(4-hydroxyphenyl)ethane, 1,1-bis(3-hydroxyphenyl)ethane, 1-(3-hydroxyphenyl)-1-(4-hydroxyphenyl)ethane, 1,1-bis(4-hydroxyphenyl)ethane, 1,1-bis(2-hydroxy-3-methylphenyl)ethane, 1,1-bis(2-hydroxy-3-ethylphenyl)ethane, 1-(2-hydroxy-3-methylphenyl)-1-(3-hydroxy-4-methylphenyl)ethane, 1-(2-hydroxy-3-ethylphenyl)-1-(3-hydroxy-4-ethylphenyl)ethane, 1-(2-hydroxy-3-methylphenyl)-1-(4-hydroxy-3-methylphenyl) ethane, 1-(2-hydroxy-3-ethylphenyl)-1-(4-hydroxy-3-ethylphenyl)ethane, 1,1-bis(3-hydroxy-4-methylphenyl) ethane, 1,1-bis(3-hydroxy-4-ethylphenyl)ethane, 1-(3-hydroxy-4-methylphenyl)-1-(4-hydroxy-3-methylphenyl) ethane, 1-(3-hydroxy-4-ethylphenyl)-1-(4-hydroxy-3-ethylphenyl)ethane, 1,1-bis(4-hydroxy-3-methylphenyl) ethane, 1,1-bis(4-hydroxy-3-ethylphenyl)ethane.

In view of the convenience in producing the bivalent phenol compound, among these, 1,1-bis(4-hydroxyphenyl) ethane, 1-(2-hydroxyphenyl)-1-(4-hydroxyphenyl)ethane, 1,1-bis(2-hydroxyphenyl)ethane, 1,1-bis(4-hydroxy-3-methylphenyl)ethane, 1,1-bis(4-hydroxy-3-ethylphenyl)ethane compounds are particularly preferable. A plurality of these bivalent phenol compounds can be used in combination with one another.

[Chemical Formula 18]

$$-(A\text{-}D)_n- \quad (3)$$

In the general formula 3, D represents a compound having the bivalent phenol residue represented by the following formula D in the molecule.

[Chemical formula 19]

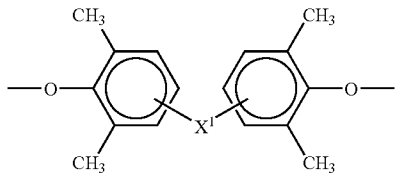

(D)

$X^1$ of the bivalent phenol residue represented by formula D is a single bond or a bivalent group. For the bivalent group for $X^1$, for example, a sulfur atom, an oxygen atom, a sulfonyl group, cycloalkylene group, (—$CR^{17}R^{18}$—), or the like, are suitable. Here, each of $R^{17}$ and $R^{18}$ which are independent of each other is a hydrogen atom, an alkyl group, an aryl group, a halogen group, or an alkoxy group. In view of mechanical properties required of the binder resin for the photosensitive layer, and of solubility in the solvent used in preparing a coating liquid for forming the photosensitive layer, a phenyl group and a naphthyl group are preferable for the aryl group, a fluorine atom, a chlorine atom, a bromine atom, and an iodine atom are preferable for the halogen group, a methoxy group, an ethoxy group, a butoxy group, and the like, are preferable for the alkoxy group. For the alkyl group, an alkyl group having a carbon number of 1 to 10 is preferable, an alkyl group having a carbon number of 1 to 8 is more preferable, and an alkyl group having a carbon number of 1 to 2 is further preferable.

Also, in view of the convenience in producing the bivalent phenol component used in producing the polyester resin, for $X^1$, —O—, —S—, —SO—, —$SO_2$—, —CO—, —$CH_2$—, —$CH(CH_3)$—, —$C(CH_3)_2$—, and a cyclohexylidene group may be given. Among these, —$CH_2$—, —$CH(CH_3)$—, —$C(CH_3)_2$—, and a cyclohexylidene group are preferable, and —$CH_2$—, and a cyclohexylidene group are particularly preferable.

The specific examples of the bivalent phenol compound which serves as a bivalent phenol residue represented by formula D include, for example, 3,3',5,5'-tetramethyl-4,4'-dihydroxybiphenyl, 2,4,3',5'-tetramethyl-3,4'-dihydroxybiphenyl, 2,2',4,4'-tetramethyl-3,3'-dihydroxybiphenyl, bis(4-hydroxy-3,5-dimethylphenyl)ether, (4-hydroxy-3,5-dimethylphenyl)(3-hydroxy-2,4-dimethylphenyl)ether, bis (3-hydroxy-2,4-dimethylphenyl)ether, bis(4-hydroxy-3,5-dimethylphenyl)methane, (4-hydroxy-3,5-dimethylphenyl) (3-hydroxy-2,4-dimethylphenyl)methane, bis(3-hydroxy-2,4-dimethylphenyl)methane, 1,1-bis(4-hydroxy-3,5-dimethylphenyl)ethane, 1-(4-hydroxy-3,5-dimethylphenyl)-1-(3-hydroxy-2,4-dimethylphenyl)ethane, 1,1-bis(3-hydroxy-2,4-dimethylphenyl)ethane, 2,2-bis(4-hydroxy-3,5-dimethylphenyl)propane, 2-(4-hydroxy-3,5-dimethylphenyl)-2-(3-hydroxy-2,4-dimethylphenyl) propane, 2,2-bis(3-hydroxy-2,4-dimethylphenyl)propane, 1,1-bis(4-hydroxy-3,5-dimethylphenyl)cyclohexane, 1-(4-hydroxy-3,5-dimethylphenyl)-1-(3-hydroxy-2,4-dimethylphenyl)cyclohexane, 1,1-bis(3-hydroxy-2,4-dimethylphenyl)cyclohexane and the like.

3,3',5,5'-tetramethyl-4,4'-dihydroxybiphenyl, bis(4-hydroxy-3,5-dimethylphenyl)ether, bis(4-hydroxy-3,5-dimethylphenyl)methane, 1,1-bis(4-hydroxy-3,5-dimethylphenyl) ethane, 2,2-bis(4-hydroxy-3,5-dimethylphenyl)propane, and 1,1-bis(4-hydroxy-3,5-dimethylphenyl)cyclohexane are preferably given among them.

In addition, in view of the convenience in producing the bivalent phenol compound, bis(4-hydroxy-3,5-dimethylphenyl)methane, 2,2-bis(4-hydroxy-3,5-dimethylphenyl)propane, and 1,1-bis(4-hydroxy-3,5-dimethylphenyl)cyclohexane are particularly preferable. A plurality of these bivalent phenol compounds can be used in combination with one another.

[Chemical Formula 20]

$$-(A\text{-}E)_n- \quad (4)$$

In the general formula 4, E represents a compound having the bivalent phenol residue represented by the following formula E in the molecule.

[Chemical formula 21]

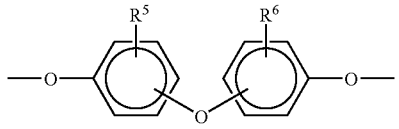

(E)

In formula E, each of $R^5$ and $R^6$ which are independent of each other represents a hydrogen atom, an alkyl group, an aryl group, a halogen group, or an alkoxy group. In view of mechanical properties required of the binder resin for the photosensitive layer, and in view of solubility in the solvent used in preparing a coating liquid for forming the photosensitive layer, a phenyl group and a naphthyl group are preferable for the aryl group, a fluorine atom, chlorine atom, a bromine atom, and iodine atom are preferable for the halogen group, and a methoxy group, an ethoxy group, and a butoxy group are preferable for the alkoxy group. For the alkyl group, an alkyl group having a carbon number of 1 to 10 is preferable, an alkyl group having a carbon number of 1 to 8 is more preferable, and an alkyl group having a carbon number of 1 to 2 is further preferable.

The specific examples of the bivalent phenol compound which serves as a bivalent phenol residue represented by formula E include, for example, bis(2-hydroxyphenyl)ether, (2-hydroxyphenyl)(3-hydroxyphenyl)ether, (2-hydroxyphenyl)(4-hydroxyphenyl)ether, bis(3-hydroxyphenyl)ether, (3-hydroxyphenyl)(4-hydroxyphenyl)ether, bis(4-hydroxyphenyl)ether, bis(2-hydroxy-3-methylphenyl)ether, bis(2-hydroxy-3-ethylphenyl)ether, (2-hydroxy-3-methylphenyl)(3-hydroxy-4-methylphenyl)ether, (2-hydroxy-3-ethylphenyl)(3-hydroxy-4-ethylphenyl)ether, (2-hydroxy-3-methylphenyl)(4-hydroxy-3-methylphenyl)ether, (2-hydroxy-3-ethylphenyl)(4-hydroxy-3-ethylphenyl)ether, bis(3-hydroxy-4-methylphenyl)ether, bis(3-hydroxy-4-ethylphenyl)ether, (3-hydroxy-4-methylphenyl)(4-hydroxy-3-methylphenyl)ether, (3-hydroxy-4-ethylphenyl)(4-hydroxy-3-ethylphenyl)ether, bis(4-hydroxy-3-methylphenyl)ether, bis(4-hydroxy-3-ethylphenyl)ether.

In view of the convenience in producing the bivalent phenol compound which serves as a bivalent phenol residue, of these compounds are particularly preferable bis(4-hydroxyphenyl)ether, (2-hydroxyphenyl)(4-hydroxyphenyl)ether, bis(2-hydroxyphenyl)ether, bis(4-hydroxy-3-methylphenyl)ether, bis(4-hydroxy-3-ethylphenyl)ether. A plurality of these bivalent phenol compounds can be used in combination with one another.

[Chemical formula 22]

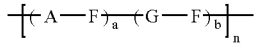

(5)

In the general formula 5, a/(a+b) is more than 0.7, and is preferably 0.8 or more. However, it must be 1 or less, and preferably must be 0.9 or less.

Polyester resin having repeating units represented by the general formula 5 is a copolymer of a repeating units represented by -(A-F)- and a repeating units represented by -(G-F)-. This copolymer may be a random copolymer or a block copolymer, of the two aforementioned repeating units. The block copolymer may be a multi-block copolymer. Among these copolymers, the random copolymer is preferable in view of easiness in production.

In formula 5, F represents a compound having a structure of the bivalent phenol residue represented by the following formula F in the molecule.

[Chemical formula 23]

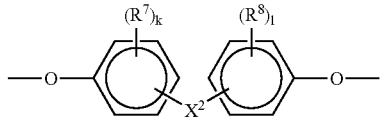

(F)

$X^2$ of the bivalent phenol compound which serves as a bivalent phenol residue represented by formula F is a single bond or a bivalent group. A sulfur atom, an oxygen atom, a sulfonyl group, cycloalkylene group, or (—$CR^{19}R^{20}$—), and the like, are given as suitable examples for the bivalent group. Here, each of $R^{19}$ and $R^{20}$ which are independent of each other represents a hydrogen atom, an alkyl group, an aryl group, a halogen group, or an alkoxy group. In view of mechanical properties required of the binder resin for the photosensitive layer, and in view of solubility in the solvent used in preparing a coating liquid for forming the photosensitive layer, a phenyl group and a naphthyl group are preferable for the aryl group, a fluorine atom, chlorine atom, a bromine atom, and an iodine atom are preferable for the halogen group, and a methoxy group, an ethoxy group, and a butoxy group are preferable for the alkoxy group. For the alkyl group, an alkyl group having a carbon number of 1 to 10 is preferable, an alkyl group having a carbon number of 1 to 8 is more preferable, and an alkyl group having a carbon number of 1 to 2 is further preferable.

Furthermore, in view of the convenience in producing the bivalent phenol compound, which serves as a bivalent phenol residue used in producing polyester resin, for $X^2$, —O—, —S—, —SO—, —$SO_2$—, —CO—, —$CH_2$—, —CH($CH_3$)—, —$C(CH_3)_2$—, and a cyclohexylidene group may be given. Among these, —$CH_2$—, —CH($CH_3$)—, —$C(CH_3)_2$—, and a cyclohexylidene group are particularly preferable.

In formula F, each of $R^7$ and $R^8$ which are independent of each other is a hydrogen atom, an alkyl group, an aryl group, a halogen group, or an alkoxy group. In view of mechanical properties required of the binder resin for the photosensitive layer, and in view of solubility in the solvent used in preparing a coating liquid for forming the photosensitive layer, a phenyl group and a naphthyl group are preferable for the aryl group, a fluorine atom, chlorine atom, a bromine atom, and iodine atom are preferable for the halogen group, and a methoxy group, an ethoxy group, and a butoxy group are preferable for the alkoxy group. For the alkyl group, an alkyl group having a carbon number of 1 to 10 is preferable, an alkyl group having a carbon number of 1 to 8 is more preferable, and an alkyl group having a carbon number of 1 to 2 are further preferable. Also, each of k and l which are independent of each other represents an integer from 1 to 4.

Particularly preferable examples of formula F include, for example, bis(4-hydroxyphenyl)methane, (2-hydroxyphenyl)(4-hydroxyphenyl)methane, bis(2-hydroxyphenyl)methane, 1,1-bis(4-hydroxyphenyl)ethane, 2,2-bis(4-hydroxyphenyl)propane, 1,1-bis(4-hydroxyphenyl)cyclohexane, bis(4-hydroxyphenyl)ketone, bis(4-hydroxyphenyl)ether, bis(4-hydroxy-3-methylphenyl)methane, 1,1-bis(4-hydroxy-3-methylphenyl)ethane, 2,2-bis(4-hydroxy-3-methylphenyl)propane, 1,1-bis(4-hydroxy-3-methylphenyl)cyclohexane, bis(4-hydroxy-3-methylphenyl)ether, bis(4-hydroxy-3,5-dimethylphenyl)methane, 1,1-bis(4-hydroxy-3,5-dimethylphenyl)ethane, 2,2-bis(4-hydroxy-3,5-dimethylphenyl)propane, 1,1-bis(4-hydroxy-3,5-dimethylphenyl)cyclohexane. A plurality of these bivalent phenol compounds can be used in combination with one another.

In formula 5, G represents a compound having a structure of the dicarboxylic acid residue represented by the following formula G in the molecule.

[Chemical formula 24]

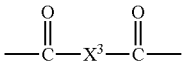

(G)

In formula G, $X^3$ represents a bivalent group. Bivalent groups suitable for $X^3$ include, for example, the bivalent group of saturated aliphatic hydrocarbons such as a methylene group, and an ethylene group; an arylene group which may have a substituent such as a p-phenylene group, 1,4-naphthylene group, and 3-methyl-p-phenylene group.

The specific examples of a dicarboxylic acid residue represented by formula G include, for example: a dicarboxylic acid residue of saturated aliphatic hydrocarbons such as an adipic acid residue, a suberic acid residue, and a sebacic acid residue; a dicarboxylic acid residue of aromatic hydrocarbons such as a phthalic acid residue, an isophthalic acid residue, a terephthalic acid residue, and a toluene-2,5-dicarboxylic acid residue; a heterocyclic dicarboxylic acid residue such as a p-xylene-2,5-dicarboxylic acid residue, a pyridine-2,3-dicarboxylic acid residue, a pyridine-2,4-dicarboxylic acid residue, a pyridine-2,5-dicarboxylic acid residue, a pyridine-2,6-dicarboxylic acid residue, a pyridine-3,4-dicarboxylic acid residue, a pyridine-3,5-dicarboxylic acid residue; a condensed polycyclic dicarboxylic acid residue, such as a naphthalene-1,4-dicarboxylic acid residue, a naphthalene-2,3-dicarboxylic acid residue, a naphthalene-2,6-dicarboxylic acid residue; a dicarboxylic acid residue of a hydrocarbon ring assembly such as a 2,2'-biphenyldicarboxylic acid residue, a 4,4'-biphenyldicarboxylic acid residue. Among these, preferable are the adipic acid residue, the sebacic acid residue, the phthalic acid residue, the isophthalic acid residue, the terephthalic acid residue, the naphthalene-1,4-dicarboxylic acid residue, the naphthalene-2,6-dicarboxylic acid residue, the 2,2'-biphenyldicarboxylic acid residue, the 4,4'-biphenyldicarboxylic acid residue. More preferable is the dicarboxylic acid residue of an aromatic hydrocarbon, and particularly preferable is the isophthalic acid residue and terephthalic acid residue. A plurality of these dicarboxylic acid residues can be used in combination with one another.

Polyester resin having repeating units represented by one of the aforementioned general formulae 1 to 5 may be mixed with another resin to be used for the photosensitive layer of the electrophotographic receptor to which the present embodiment is applied. The resin to be here mixed, for example, may be: a vinyl polymer such as a poly(methyl methacrylate), a polystyrene and a poly(vinyl chloride), and copolymers thereof; thermoplastic resins such as a polycarbonate resin, a polyester resin, a polyester polycarbonate resin, a polysulfone resin, a phenoxy resin, an epoxy resin, and a silicon resin; or various kinds of thermosetting resins. The polycarbonate resin is preferable among these resins. A mixing ratio of resins to be used in combination with the polyesters having the repeating units represented by one of the general formulae 1 to 5 is not particularly limited. But, in usual, they are preferably mixed in the mixing ratio thereof which does not exceed a mixing ratio of the polyesters.

(Method of Producing Polyester Resin)

Next, a method of producing polyester resin having repeating units represented by one of the general formulae 1 to 5 will be described below.

The method of producing polyester resin having repeating units represented by one of the general formulae 1 to 5 is not particularly limited, but known polymerization methods such as an interfacial polymerization, a melt polymerization, and a solution polymerization can be used.

In a case of producing polyester resin by the interfacial polymerization method, for example, a solution prepared by dissolving a bivalent phenol component in an aqueous alkaline solution and a solution of a halogenated hydrocarbon prepared by dissolving aromatic dicarboxylic acid dichloride component therein are mixed. In this case, quaternary ammonium salt or quaternary phosphonium salt can be used as a catalyst. In view of productivity, a polymerization temperature is preferably within a range from 0° C. to 40° C., and a polymerization time is preferably within a range from 2 to 20 hours. After completing polymerization, an aqueous phase and an organic phase are separated. Then, the polymer dissolved in the organic phase is washed and recovered by means of a known method to obtain the targeted resin.

Alkaline components used in the interfacial polymerization method include, for example, alkali metal hydroxides such as a sodium hydroxide, and a potassium hydroxide. The amount of the alkali component used is preferably within a range from 1.01 to 3 times the equivalent weight of phenolic hydroxyl group contained in the reaction system. The halogenated hydrocarbons may, for example, be dichloromethane, chloroform, 1,2-dichloroethane, trichloroethane, tetrachloroethane, and dichlorobenzene. The quaternary ammonium salt or the quaternary phosphonium salt used as the catalyst may, for example, be a salt such as the chloride, bromide, and iodide of a tertiary alkylamine such as tributylamine and trioctylamine, benzyltriethylammonium chloride, benzyltrimethylammonium chloride, benzyltributylammonium chloride, tetraethyl ammonium chloride, tetrabutyl ammonium chloride, tetrabutylammonium bromide, trioctylmethylammonium chloride, tetrabutyl phosphonium bromide, triethyloctadecyl phosphonium bromide, N-laurylpyridinium chloride, and lauryl picolynium chloride.

Moreover, in the interfacial polymerization method, a molecular weight modifier can be used. The molecular weight modifier includes, for example, phenol; alkylphenols such as o, m, p-cresol, o, m, p-ethylphenol, o, m, p-propylphenol, o, m, p-(tert-butyl)phenol, pentylphenol, hexylphenol, octylphenol, nonylphenol, 2,6-dimethylphenol derivative, 2-methylphenol derivative; a monofunctional phenol such as o, m, p-phenylphenol; and a monofunctional acid halide such as acetic chloride, butyric chloride, octylic chloride, benzoyl chloride, benzene sulfonyl chloride, benzene sulfinyl chloride, sulfinyl chloride, benzene phosphonyl chloride, or a substituted products thereof. Among these molecular weight modifiers, the o, m, p-(tert-butyl)phenol, the 2,6-dimethylphenol derivative, and the 2-methylphenol derivative are preferable in view of a high molecular weight modifying performance and a solution stability. Particularly preferable are the p-(tert-butyl)phenol, the 2,3,6-trimethylphenol, and the 2,3,5-trimethylphenol.

Next, other components contained in the photosensitive layer of the electrophotographic photoreceptor to which the present embodiment is applied will be described below.

(Charge Generation Layer)

In the case where the electrophotographic photoreceptor to which the present embodiment is applied is a lamination type, a charge generating material is contained in a charge generation layer forming a photosensitive layer. The charge generating material includes, for example, selenium and alloys thereof, cadmium sulfide, and other inorganic photoconductive materials, and various photoconductive materials including organic pigments such as phthalocyanine pigments, azo pigments, quinacridone pigments, indigo pigments, perylene pigments, polycyclic quinone pigments, anthanthrone pigments, and benzimidazole pigments. The organic pigments are particularly preferable among these materials, and phthalocyanine pigment and azo pigment are more preferable. The fine particles of these charge generating materials are used in a form in which the particles are bound by various kinds of binder resins such as polyester resin, poly(vinyl acetate), poly(acrylic acid ester), poly(methacrylic acid ester), polyester, polycarbonate, poly(vinyl acetoacetal), poly(vinyl propional), poly(vinyl butylal), phenoxy resin, epoxy resin, urethane resin, cellulose ester, and cellulose ether. The amount of the charge generating material to be used is not particularly limited, but the amount thereof is usually in a range from 30 to 500 parts by weight per 100 parts by weight of the binder resin. Note that, the film thickness of the charge generation layer is usually 0.1 to 1 μm, and preferably 0.15 to 0.6 μm.

In a case of using the phthalocyanine compounds as a charge generating material, specifically, metal-free phthalocyanine and phthalocyanines wherein metals such as copper, indium, gallium, tin, titan, zinc, vanadium, silicon, germanium, oxides thereof, or halides thereof are coordinated are used. The examples of a ligand to be coordinated with a trivalent or more metallic atom include an oxygen atom, a chlorine atom, as well as a hydroxyl group and an alkoxy group. A highly sensitive X-type and τ-type metal-free phthalocyanine, the A-type, B-type and D-type of titanyl phthalocyanine, vanadyl phtalocyanine, chloroindium phthalocyanine, chlorogallium phthalocyanine, and hydroxygallium phthalocyanine are particularly preferable. Note that, W, Heller et al. have shown the A-type and the B-type crystalline types of titanyl phthalocyanine cited here as I- and II-phases, respectively (see Zeit. Kristallogr. 159 (1982) 173). The A-type is known as a stable form. D-form is a crystalline type which exhibits a distinctive peak at a diffraction angle 2θ±0.2° of 27.3° in a powder X-ray diffraction using a CuKα line. For the phthalocyanine compound, either a single compound or the mixture of some compounds may be used. In order to obtain the phthalocyanine compounds or the crystals thereof in mixture state, components may be mixed with each other after or during the production/treatment process of the phthalocyanine compound, such as synthesis, formation into pigment, and crystallization. These known treatments include an acid paste treatment, a grinding treatment, and a solvent treatment.

(Charge Transport Layer)

In the case where the electrophotographic photoreceptor to which the present embodiment is applied is of a lamination type, a charge transporting material is contained in a charge transport layer forming a photosensitive layer. The charge transporting material includes, for example, aromatic nitro compounds such as 2,4,7-trinitrofluorenone; cyano compounds such as tetracyanoquinodimethane; electron-withdrawing materials such as quinones including diphenoquinone; heterocyclic compounds such as carbazole derivatives, indole derivatives, imidazole derivatives, oxazole derivatives, pyrazole derivatives, oxadiazole derivatives, pyrazoline derivatives, thiadiazole derivatives; aniline derivatives, hydrazone compounds, aromatic amine derivatives, stilbene derivatives, butadiene derivatives, enamine compounds, and the ones obtained by combining a plurality of these compounds; or electron-donating materials such as polymers having a group formed of these compounds at a main chain or a side chain thereof. Among these, carbazole derivatives, hydrazone derivatives, aromatic amine derivatives, stilbene derivatives, butadiene derivatives, and the ones obtained by combining a plurality of these derivatives are preferable. The ones obtained by combining a plurality of the aromatic amine derivatives, stilbene derivatives, or butadiene derivatives are particularly preferable.

Among the charge transporting materials, preferably used is the compound having the structure represented by the following general formula 6.

[Chemical formula 25]

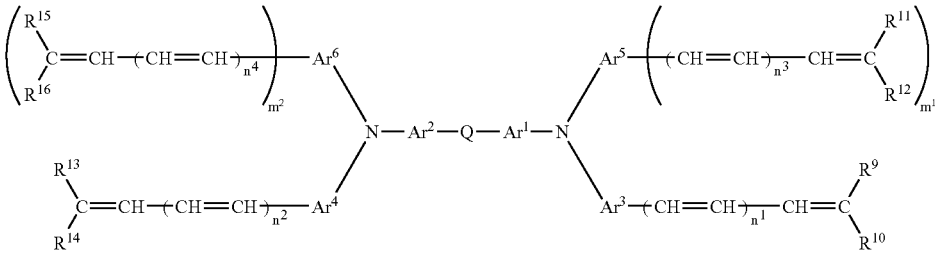

(6)

In the general formula 6, each of $Ar^1$ to $Ar^6$ which are independent of one another, represents an arylene group which may have a substituent or a bivalent heterocyclic group which may have a substituent. Each of $m^1$ and $m^2$ which are independent of each other represents 0 or 1. $Ar^5$ in the case of $m^1=0$, and $Ar^6$ in the case of $m^2=0$ are independently an alkyl group which may have a substituent, aryl group which may have a substituent, or monovalent heterocyclic group which may have a substituent. $Ar^5$ in the case of $m^1=1$, and $Ar^6$ in the case of $m^2=1$ are independently an alkylene group which may have a substituent, arylene group which may have a substituent, or bivalent heterocyclic group which may have a substituent. Q represents a direct bond or a bivalent residue. Each of $R^9$ to $R^{16}$ which are independent of each other represents a hydrogen atom, an alkyl group which may have a substituent, an aryl group which may have a substituent, or a heterocyclic group which may have a substituent. Each of $n^1$ to $n^4$ which are independent of each other represents an integer from 0 to 4. Also, $Ar^1$ to $Ar^6$ may be bonded with each other to form a cyclic structure.

Furthermore, in the general formula 6, each of $R^9$ to $R^{16}$ which are independent of each other is a hydrogen atom, an alkyl group which may have a substituent, aryl group which may have a substituent, aralkyl group which may have a substituent, or heterocyclic group which may have a substituent.

In the general formula 6, the alkyl group includes, for example, a methyl group, an ethyl group, a propyl group, an isopropyl group, a butyl group, a pentyl group, a hexyl group, a heptyl group, a cyclopentyl group, and a cyclohexyl group. An alkyl group having a carbon number of 1 to 6 is preferable among these groups. When the alkyl group has an aryl substituent, a benzyl group and a phenethyl group are included in the alkyl group, and an aralkyl group having a carbon number of 7 to 12 is preferable.

The aryl group includes a phenyl group, a tolyl group, a xylyl group, a naphthyl group, a pyrenyl group, and an aryl group having a carbon number of 6 to 12 is preferable.

The heterocyclic group preferably includes an aromatic heterocyclic ring, for example, a furyl group, a thienyl group, and a pyridyl group. A monocyclic aromatic heterocyclic ring is more preferable. For $R^7$ to $R^{14}$, the most preferable are the methyl group and the phenyl group.

In the general formula 6, each of $Ar^1$ to $Ar^6$ which are independent of each other represents an arylene group which may have a substituent or a bivalent heterocyclic group which may have a substituent. Each of $m^1$ and $m^2$ which are independent of each other represents 0 or 1. $Ar^5$ in the case of $m^1=0$, and $Ar^6$ in the case of $m^2=0$ are independently an alkyl group which may have a substituent, aryl group which may have a substituent, or monovalent heterocyclic group which may have a substituent. $Ar^5$ in the case of $m^1=1$, and $Ar^6$ in the case of $m^2=1$ are independently an alkylene group which may have a substituent, arylene group which may have a substituent, or bivalent heterocyclic group which may have a substituent. Specifically, the aryl group includes a phenyl group, a tolyl group, a xylyl group, a naphthyl group, and a pyrenyl group. An aryl group having a carbon number of 6 to 14 is preferable. The arylene group includes a phenylene group, and a naphthylene group, and the phenylene group is preferable.

In the general formula 6, a preferable monovalent heterocyclic group is an aromatic heterocyclic ring, which includes, for example, a furyl group, a thienyl group, and a pyridyl group. A monocyclic aromatic heterocyclic ring is more preferable. A preferable bivalent heterocyclic group is an aromatic heterocyclic ring, which includes, for example, a pyridilene group and a thienylene group. A monocyclic aromatic heterocyclic is more preferable. Among these, the most preferable are the phenylene group as $Ar^1$ and $Ar^2$, and the phenyl group as $Ar^3$.

In the general formula 6, each of the alkyl group, the aryl group, the aralkyl group, and the heterocyclic group among the groups represented by $R^9$ to $R^{16}$ and $Ar^1$ to $Ar^6$ may further have a substituent. The substituent includes, for example, a halogen atom such as a fluorine atom, a chlorine atom, a bromine atom, and an iodine atom; an alkyl group such as a methyl group, an ethyl group, a propyl group, an isopropyl group, a butyl group, an isobutyl group, a sec-butyl group, a tert-butyl group, a pentyl group, a hexyl group, a cyclopentyl group, and a cyclohexyl group; an alkoxy group such as a methoxy group, an ethoxy group, and a propyloxy group; an alkylthio group such as a methylthio group, and an ethylthio group; an alkenyl group such as a vinyl group, and an aryl group; an aralkyl group such as a benzyl group, a naphthylmethyl group, and a phenethyl group; an aryloxy group such as a phenoxy group, and a tolyloxy group; an arylalkoxy group such as a benzyloxy group, a phenethyloxy group; an aryl group such as a phenyl group, a naphthyl group; an arylvinyl group such as a styryl group, and a naphthylvinyl group; an acyl group such as an acetyl group, and a benzoyl group; a dialkylamino group such as a dimethylamino group, and a diethylamino group; a diarylamino group such as a diphenylamino group, and a dinaphthylamino group; a diaralkylamino group such as a dibenzylamino group, a diphenethylamino group, and a diheterocyclic amino group such as a dipyridylamino group, and a dithienylamino group; a substituted amino group such as a diarylamino group and a disubstituted amino group formed by combining the substituent of the above amino group; and furthermore a cyano group, a nitro group, a hydroxyl group. These substituents may be bonded with each other to form a cyclic hydrocarbon group and a heterocyclic group with a single bond, a methylene group, an ethylene group, a carbonyl group, a vinylidene group, and an ethylenylene group.

The preferable substituent among these includes a halogen atom, a cyano group, a hydroxyl group, an alkyl group having a carbon number of 1 to 6, an alkoxy group having a carbon number of 1 to 6, an alkylthio group having a carbon number of 1 to 6, an aryloxy group having a carbon number of 6 to 12, an arylthio group having a carbon number of 6 to 12, a dialkylamino group having a carbon number of 2 to 8. A halogen atom, an alkyl group having a carbon number of 1 to 6, and a phenyl group are more preferable, and a methyl group and a phenyl group are particularly preferable.

In the general formula 6, each of $n^1$ to $n^4$ which are independent of each other represents an integer from 0 to 4, preferably from 0 to 2, and particularly preferably 1. Each of $m^1$ and $m^2$ represents 0 or 1, preferably 0.

In the general formula 6, Q represents a direct bond or a bivalent residue. The preferable bivalent residue includes chalcogen atoms, an alkylene group which may have a substituent, an arylene group which may have a substituent, a cycloalkylidene group which may have a substituent, or one formed by bonding these groups to each other, for example, [—O—Z—O—], [—Z—O—Z—], [—S—Z—S—], [—Z—Z—] (Here, O represents an oxygen atom, S represents a sulfur atom, and Z represents an arylene group which may have a substituent or alkylene group which may have a substituent.)

The alkylene group consisting Q is preferably one having a carbon number of 1 to 6, and more preferably are a methylene group and an ethylene group, among these. The cycloalkylidene group is preferably one having a carbon number of 5 to 8, and more preferably are a cyclopentylidene group and a cyclohexylidene group, among these. The arylene group is preferably one having a carbon number of 6 to 14, and particularly preferably a phenylene group and a naphthylene group, among these.

Moreover, each of the alkylene group, the arylene group, and the cycloalkylidene group may have a substituent. The substituent is preferably a hydroxyl group, a nitro group, a cyano group, a halogen atom, an alkyl group having a carbon number of 1 to 6, an alkenyl group having a carbon number of 1 to 6, and an aryl group having a carbon number of 6 to 14.

The specific examples of the charge transporting materials contained in the charge transport layer constituting the photosensitive layer of the electrophotographic photoreceptor to which the present embodiment is applied include, for example, arylamine compounds described in the Japanese Laid-open Patent Application No. 9-244278, and arylamine compounds described in the Japanese Laid-open Patent Application No. 2002-275133. These charge transporting materials may be used both singularly and in combination with one another. The charge transport layer is formed by binding these charge transporting materials with the binder resin. The charge transport layer may be formed of a single layer or a plurality of stacked layers having different components or composition ratios from one another.

As for the ratio of the binder resin formed of polyester resin having repeating units represented by one of the general formulae 1 to 5 to the charge transport material, in general, the charge transport material is used in an amount of, generally from 30 to 200 parts by weight, preferably from 40 to 150 parts by weight, per 100 parts by weight of the binder resin. Furthermore, the film thickness of the charge transport layer is generally from 5 to 50 μm, preferably from 10 to 45 μm.

Note that, in order to improve film-forming property, flexibility, coating property, stain resistance, gas resistance, and light resistance, the charge transport layer is allowed to contain additives such as known plasticizers, antioxidants, ultraviolet absorbers, an electron-withdrawing compound, dyes, pigments, and leveling agents. Examples of antioxidant include a hindered phenol compound and a hindered amine compound. Also, Examples of the dyes and pigments include various kinds of dye compounds, and azo compounds.

(Dispersion Type (Single Layer Type) of Photosensitive Layer)

In the case of the dispersion type photosensitive layer, the aforementioned charge generating material is dispersed in the charge transporting medium having the above mentioned binder resin and the charge transporting material. The particle size of the charge generating material is necessary to be sufficiently small. It is preferably 1 μm or less, more preferably 0.5 μm or less. If the amount of the charge generating material dispersed in the photosensitive layer is too small, sufficient sensitivity is not obtained. On the contrary, if the amount is too large, it causes problems such as reduction in charging and sensitivity. The amount of the charge generating material to be used is preferably in a range from 0.5 to 50% by weight, more preferably in a range from 1 to 20% by weight.

The film thickness of the dispersion type photosensitive layer to be used is usually 5 μm to 50 μm, and 10 μm to 45 μm. In addition, in this case, additives may also be added such as known plasticizers for improving the film-forming property, the flexibility, the mechanical strength and the like; additives for controlling the residual potential; dispersant aids for improving the dispersion stability, leveling agents and surfactants for improving the coating performance such as a silicon oil, and a fluorine-based oil, and other additives. A protective layer may be provided on the dispersion type photosensitive layer for the purpose of preventing the dispersion type photosensitive layer from being worn, or preventing and reducing deterioration of the dispersion type photosensitive layer due to corona products, and the like, generated from a charging device, or the like. Moreover, the surface layer thereof may also contain fluorine-based resin or silicon resin for the purpose of reducing friction resistance and wear on the surface of the electrophotographic photoreceptor. Furthermore, the surface may also contain particles formed of these resins or inorganic compounds.

(Method of Preparing the Electrophotographic Photoreceptor)

The method of preparing the electrophotographic photoreceptor to which the present embodiment is applied is not particularly limited. However, usually, the electrophotographic photoreceptor is formed by coating a coating liquid for forming the photosensitive layer containing polyester resin having repeating units represented by one of the general formulae 1 to 5 on an electroconductive substrate by means of a known method, such as a dip coating method, a spray coating method, a nozzle coating method, a bar coating method, a roll coating method, and a blade coating method. The dip coating method among these methods is preferable because of high productivity thereof.

(Subbing Layer)

The electrophotographic photoreceptor to which the present embodiment is applied may be provided with a subbing layer between the electroconductive substrate and the photosensitive layer in order to improve an adhesion property thereof and blocking tendency. For the subbing layer, for example, resin, and resin having the particles of a metal oxide dispersed therein are used. The examples of the metal oxide particles used in the subbing layer include, for example, metal oxide particles containing one of metallic elements such as a titanium oxide, an aluminum oxide, a silicon oxide, a zirconium oxide, a zinc oxide, a ferrous oxide, and the metal oxide particles containing a plurality of metallic elements such as calcium titanate, strontium titanate, barium titanate. These metal oxide particles may be used singly, or in mixture of a plurality thereof.

Among these, the titanium oxide and the aluminum oxide are preferable, and the titanium oxide is particularly preferable. The particles of titanium oxide may be surface-treated by inorganic materials such as tin oxide, aluminum oxide, antimony oxide, zirconium oxide or silicon oxide, or by organic materials such as stearic acid, polyol, or silicone. Any crystal form of the titanium oxide particle, such as rutile, anatase, brookite, and amorphous may be used. In addition, a plurality of crystal forms thereof may be contained in combination with one another. Metal oxide particles of various sizes are available. However, from the aspects of characteristics and stability of the solution, an average primary particle size is preferably from 10 nm to 100 nm, and is particularly preferably from 10 nm to 50 nm.

It is desirable that the subbing layer be formed by dispersing the metal oxide particles in the binder resin. As the binder resin used in the subbing layer, phenoxy, epoxy, poly(vinyl pyrrolidone), poly(vinyl alcohol), casein, poly(acrylic acid), celluloses, gelatin, starch, polyurethane, polyimide, and polyamide can be used singularly or in a cured form with a curing agent. Particularly, alcohol-soluble copolymerized polyamide, modified polyamide, or the like is preferable among them, because it exhibits good dispersibility and coating properties. The blending ratio of the metal oxide particles to be used to the binder resin is not particularly limited, but is preferably in a range from 10 to 500% by weight, from the aspects of the stability and the coating properties of the dispersion liquid. The film thickness of the subbing layer is not particularly limited, but is preferably in a range from 0.1 μm to 20 μm, from the aspects of the photoreceptor characteristics and the coating properties. Furthermore, a known antioxidant, or the like, may also be added to the subbing layer.

An example of an image forming device using the electrophotographic photoreceptor to which the present embodiment is applied is then described below.

FIG. 1 is a view for explaining an image forming device. An image forming device 10 shown in FIG. 1 is provided with an electrophotographic photoreceptor 1, a charging device 2, an exposing device 3, a developing device 4, a transfer device 5, a cleaning device 6 and a fixing device 7. The electrophotographic photoreceptor 1 is provided with a photosensitive layer containing at least one polyester resin having repeating units represented by one of the aforementioned general formulae 1 to 5. The charging device 2 is composed of a charging roller which charges the electrophotographic photoreceptor 1. The exposing device 3 forms an electrostatic latent image on a photosensitive surface of the electrophotographic photoreceptor 1. The developing device 4 supplies a toner (T) onto the surface of the electrophotographic photoreceptor 1. The transfer device 5 transfers a toner image formed on the electrophotographic photoreceptor 1 onto a sheet of recording paper (P) by applying a predetermined voltage value (transfer voltage) in a polarity opposite to a charge potential of the toner (T). The cleaning device 6 scrapes off a residual toner adhered on the electrophotographic photoreceptor 1, and collect it. The fixing device 7 fixes the toner image transferred on the sheet of recording paper (P).

The electrophotographic photoreceptor 1 has a drum shape in which at least one of the aforementioned polyester resins is provided on a surface of a cylindrical electroconductive substrate.

The charging device 2 has a roller-shaped charging roller. Note that, the charging device 2 often employs, for example, a corona charger, such as a corotron and a scorotron, and a contact type charger such as a charging brush. Note that, the electrophotographic photoreceptor 1 and the charging device 2 are, in many cases, designed to be a single cartridge having both respective functions thereof (hereinafter in some cases referred to as a photoreceptor cartridge) so as to be detachable from the body of the image forming device 10. For example, in a case where the electrophotographic photoreceptor 1 or the charging device 2 has been deteriorated, this photoreceptor cartridge is removed from the body of the image forming device 10, and a new photoreceptor cartridge can be installed to the body of the image forming device 10 (not shown in the FIGURE).

The exposing device 3 is not particularly limited in its type as long as it is capable of forming an electrostatic latent image on the photosensitive surface of the electrophotographic photoreceptor 1. The specific examples thereof include a halogen lamp, a fluorescent light, a laser such as a semiconductor laser and He—Ne laser, and LED. It is also possible to perform the exposing by means of a photoreceptor-internal exposure process. The light used in performing the exposing is not particularly limited, but the light includes, for example, a monochromatic light having a wavelength of 780 nm, a monochromatic light having a somewhat shorter wavelength of 600 nm to 700 nm, and a monochromatic light having a short wavelength of 380 nm to 500 nm.

The developing device 4 includes a developing tank 41 in which the toner (T) is stored. Moreover, the developing tank 41 includes agitators 42, a supplying roller 43, a developing roller 44, and a restricting member 45. The agitators 42 agitate the toner (T). The supplying roller 43 supports the toner (T) stored in the tank 41 and supply it to the developing roller 44. The developing roller 44 which abuts the electrophotographic photoreceptor 1 and the supplying roller 43, supports the toner (T) supplied by the supplying roller 43 and thus allow the toner (T) to contact the surface of the electrophotographic photoreceptor 1, and the restricting member 45 abuts the developing roller 44. As required, a replenishing device (not shown in the FIGURE) may supplementarily be provided to replenish the toner (T) from a container such as a bottle, a cartridge, or the like, to the developing tank 41. The developing tank 4 is not particularly limited in its type, but can employ an arbitrary device using, for example, a dry developing method such as cascade developing, single-component conductive toner developing, double-component magnetic brush developing, and a wet developing method.

Each of the agitators 42, which is rotated by a rotation driving mechanism, agitates the toner (T) while transporting the toner (T) to the supplying roller 43. A plurality of agitators 42 may be mounted, which respectively have blades of different shapes and sizes from each other. The supplying roller 43 is formed of, for example, an electroconductive sponge. The developing roller 44 is formed of a metal roll formed by metal such as iron, stainless steel, aluminum and nickel or a resin roll formed by coating resin such as silicon resin, urethane resin or fluorine resin on a metal roll. The surface of the developing roller 44 may be subjected to smooth finish or coarse finish as required. The restricting member 45 is formed of a blade of resin, such as silicon resin and urethane resin, a blade of metal, such as stainless steel, aluminum, copper, brass, and phosphor bronze, or a metal blade coated with resin. The restricting member 45 abuts onto the developing roller 44, and is pressed onto the side of the developing roller 44 with a predetermined amount of force (a general blade linear pressure of 5 to 500 g/cm) by a spring, or the like. The restricting member 45 may be provided with a function for charging the toner (T) by means of frictional charging between the restricting member 45 and the toner (T) as required. The supplying roller 43 and the developing roller 44 are rotated by the rotation driving mechanism (not shown in the FIGURE).

The toner (T) is not particularly limited in its type, but a toner, such as a polymerized toner using a suspension polymerization method and an emulsification polymerization method can be usually used, in addition to a powder toner. Particularly, in the case of using the polymerized toner, a toner having a small particle size of about 4 to 8 μm is preferable. In addition, regarding the shape of the particle of the toner (T), toners of various particle shapes from an almost-spherical shape to a potato shape, being far from a sphere shape can be used. The polymerized toner is excellent in charging uniformity and transferring property, thus being suitably used to produce a high quality image. Note that, the toner (T) is, in many cases, stored in a toner cartridge. The cartridge is designed so as to be detachable from the body of the image forming device 10. When the toner (T) in the cartridge is finished, this toner cartridge is detached from the body of the image forming device 10, and a new cartridge can be mounted thereon. Furthermore, a cartridge which includes all of the electrophotographic photoreceptor 1, the charging device 2, and the toner (T) can be also used.

The transfer device 5 is constituted of a transfer charger, a transfer roller, a transfer belt (not shown in the FIGURE), which are disposed to be facing the electrophotographic photoreceptor 1. The transfer device 5 is not particularly limited in its type. Devices in which an arbitrary method including, for example, an electrostatic transfer method such as corona transfer, roller transfer and belt transfer, a pressure transfer method, or an adhesion transfer method can be used.

The cleaning device 6 is not particularly limited. For example, an arbitrary device such as a brush cleaner, a magnetic brush cleaner, an electrostatic brush cleaner, a magnetic roller cleaner, or a blade cleaner can be used.

The fixing device 7 includes an upper fixing member 71 having a fixing roller, a lower fixing member 72 having a fixing roller which abuts the upper fixing member 71, and a heating device 73 which is provided inside the upper fixing member 71. Note that, the heating device 73 may be provided inside the lower fixing member 72. Either the upper fixing member 71 or the lower fixing member 72 can use a known heat fixing member including a fixing roll formed by coating a silicon rubber on an original tube of metal, such as stainless steel and aluminum, a fixing roll coated with Teflon (Registered Trade Mark) resin, and a fixing sheet. In addition, either the upper fixing member 71 or the lower fixing member 72 may be configured so as to supply a release agent such as silicon oil for improving releasability thereof. They may also be configured so as to forcibly apply pressure to one another by a spring. The fixing device 7 is not particularly limited in its type. For example, a fixing device employing an arbitrary method including, for example, heat roller fixing, flush fixing, oven fixing, or pressure fixing can be provided.

Next, the operation of the image forming device 10 will be described below.

The surface (photosensitive surface) of the electrophotographic photoreceptor 1 is charged at a predetermined electric potential (for example, −600V) by the charging device 2. At this time, charging may be carried out by direct current or superposing alternate current on direct current. Then, the charged photosensitive surface of the electrophotographic photoreceptor 1 is exposed corresponding to the images to be recorded by the exposing device 3 to form an electrostatic latent image on the photosensitive surface. The development of the electrostatic latent image formed on the photosensitive surface of the electrophotographic photoreceptor 1 is then carried out by the developing device 4. That is, the developing device 4 causes the toner (T) supplied by the supplying roller 43 to be thinned by using the restricting member 45 such as a developing blade, and to be charged by friction in a predetermined polarity (here, in negative polarity, which is the same as that of the electrophotographic photoreceptor 1). The charged toner (T) is transported to the developing roller 44 while being supported thereto and caused to contact with the surface of the electrophotographic photoreceptor 1.

When the charged toner (T) supported on the developing roller 44 is caused to contact the surface of the electrophotographic photoreceptor 1, a toner image corresponding to the electrostatic latent image is formed on the photosensitive surface of the electrophotographic photoreceptor 1. Subsequently, this toner image is transferred to the sheet of recording paper (P) by the transfer device 5. The residual toner (T) which has not been transferred and thus being left on the photosensitive surface of the electrophotographic photoreceptor 1 is removed by the cleaning device 6. The toner (T) which has been transferred onto the sheet of recording paper (P) is heated up to the molten state thereof during passing through between the upper and lower fixing members 71 and 72 which have been heated at a predetermined temperature, and then cooled after passing to be fixed on the sheet of recording paper (P). Thus, the final images are obtained.

Note that, the image forming device 10 is not limited to the aforementioned configuration and may be configured so as to additionally perform, for example, a charge removal process. The charge removal process is a process of electrically neutralizing the electrophotographic photoreceptor 1 by performing exposure on the electrophotographic photoreceptor 1. The device used for a charge removal includes a fluorescent lamp, and an LED. In many cases, the intensity of light used for charge removal has exposure energy three times or more the energy which the exposure light has.

The configuration of the image forming device 10 may be further modified. For example, the image forming device 10 may be configured so as to be able to perform processes, such as pre-exposure process and auxiliary charging process, or be configured to perform an offset printing. Furthermore, the image forming device 10 may be configured for a full-color tandem system in which multiple kinds of toners (T) are used.

EXAMPLES

Hereinafter, the present embodiment will be more specifically described based on examples. However, the present embodiment is not limited by such examples. All "Parts" and "% s" used in examples and comparative examples are expressed by weight unless otherwise specified.

(Viscosity-Average Molecular Weight (Mv))

Using the Ubbellohde capillary viscometer (the falling time of dichloromethane $t_0$: 136.16 seconds), the falling time (t) of dichloromethane solution of polyester resin (Concentration: 6.00 g/L) was measured at 20.0° C. Then, the viscosity-average molecular weight (Mv) of the polyester resin was calculated using the following equations. The results are shown in Tables 1 and 2, and Tables 4 to 7.

$$\eta_{sp}=(t/t_0)-1$$

$$a=0.438\times\eta_{sp}+1$$

$$b=100\times(\eta_{sp}/C)$$

$$C=6.00[\mathrm{g/L}]$$

$$\eta=b/a$$

$$\mathrm{Mv}=3207\times\eta^{1.205}$$

(Test for Electric Characteristics)

By using an electrophotographic characteristic evaluation apparatus (described on pages 404 to 405 in "Electrophotography—Bases and Applications, Second Series" edited by the Society of Electrophotography of Japan, Published by Corona Co.), which complies with the measurement standard by the Society of Electrophotography of Japan, an evaluation test of electric characteristics was carried out as follows. A previously prepared photosensitive sheet (described below) was stuck on a drum made of aluminum to be formed in a cylindrical shape and electroconductivity between the aluminum drum and an aluminum substrate of the photosensitive sheet was attained. Then, the drum was rotated at a constant revolution rate to perform the evaluation test through cycles of charging, exposure, potential measurement and charge removal. An initial surface potential was set at −700 V, monochromatic lights having wavelengths of 780 nm and 660 nm were used respectively as an exposure light and a charge removal light, a surface potential (VL) was measured at the time of irradiation with 2.4 μJ/cm$^2$ of the exposure light. In measuring VL, the time required from the exposure to the potential measurement was set at 139 ms. The measurement was carried out under the environment of a temperature of 25° C. and a relative humidity of 50% (NN environment), and the environment of a temperature of 5° C. and a relative humidity of 10% (LL environment). The smaller the absolute value of VL value is, the better the response characteristic is (unit: −V). The results are shown in Tables 1 to 7.

(Wear Test)

A previously prepared photosensitive sheet (described below) was cut in a circle shape having a diameter of 10 cm to prepare a test sample. A wear test was carried out on this sample using Taber Abrader (by TOYO SEIKI KOGYO Co. Ltd). The wear test was carried out under the environment of a temperature of 23° C. and a relative humidity of 50% using a truck wheel CS-10F without load (the truck wheel's own weight). The wear amount after 1,000 revolutions was measured by comparing the weights between before and after the test. The less the amount is, the better the wear resistance is (unit: mg). The results are shown in Tables 1 to 7.

(Printing Resistance Test)

A previously prepared photoreceptor drum (described below) was provided on a commercially available color laser printer (LP3000C by SEIKO EPSON CORPORATION), and then, images were formed on 24,000 sheets of paper in a monochrome (black) mode under normal temperature and humidity. The film thicknesses of the photoreceptor respectively before and after the formation of the 24,000 images were measured to calculate the reduction in the amount of the film per 10,000 images formed on the sheets of paper. The less the reduction in the amount of the film is, the better printing resistance is (unit: μm). The result is shown in Table 2.

(Preparation of a Photosensitive Sheet)

10 parts by weight of oxytitanium phthalocyanine and 150 parts by weight of 4-methoxy-4-methylpentanone-2 were mixed with each other, and then, the mixture was milled and dispersed using a sand grind mill, thus producing a pigment dispersion liquid. Note that, oxytitanium phthalocyanine exhibits strong diffraction peaks at each Bragg angle (2θ±0.2) of 9.3°, 10.6°, 13.2°, 15.1°, 15.7°, 16.1°, 20.8°, 23.3°, 26.3°, and 27.1° in X-ray diffraction using a CuKα line. 50 parts by weight of 1,2-dimethoxyethane solution containing 5% by weight of poly(vinyl butylal) (trade name: Denka butyral #6000C, by TOKYO DENKI KAGAKU KOGYO KABUSHIKI KAISHA), and 50 parts by weight of 1,2-dimethoxyethane solution containing 5% by weight of phenoxy resin (trade name: PKHH, by Union Cabide Corporation) were mixed with the pigment dispersion liquid. Moreover, the suitable amount of 1,2-dimethoxyethane was further added to a coating liquid for forming a charge generation layer containing 4.0% of solid content. This coating liquid for forming a charge generation layer was applied on a poly(ethylene terephthalate) sheet having an aluminum-evaporated surface thereof so that the film thickness of the sheet after drying became 0.4 μm, and then, the sheet was dried. Thus, a charge generation layer was provided on the poly(ethylene terephthalate) sheet.

Next, a coating liquid for forming a charge transport layer was applied on the charge generation layer so that the film thickness of the layer after drying became 20 μm, and then the layer was dried for 20 minutes at 125° C., thus forming a charge transport layer. Accordingly, a photosensitive sheet was prepared. The coating liquid for forming a charge transport layer was prepared by mixing 100 parts by weight of polyester resin, 8 parts by weight of an antioxidant (Irganox 1076, by Ciba-Geigy LTd.), 0.03 parts by weight of silicone oil, which is a leveling agent, and 50 parts by weight of a charge transporting material, which is constituted of an isomer mixture having the charge transporting material 1 of the following chemical structure as the main component, which are each shown in Tables 1 and 7, with 640 parts by weight of tetrahydrofuran/toluene mixed solvent (80% by weight of tetrahydrofuran and 20% by weight of toluene).

[Chemical formula 26]

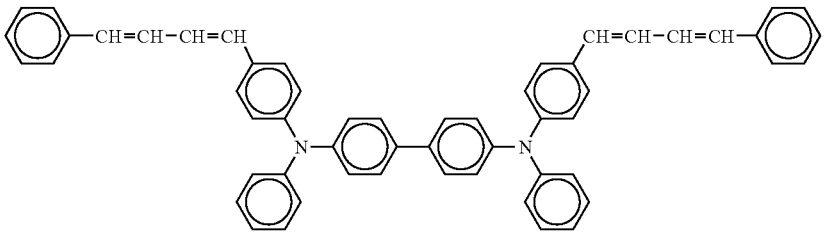

. . . charge transporting material 1

(Preparation of Photoreceptor Drum)

10 parts of oxytitanium phthalocyanine was added to 150 parts of 1,2-dimethoxyethane. The mixture was milled and dispersed using a sand grind mill to prepare pigment dispersion liquid. Note that, oxytitanium phthalocyanine exhibits distinctive diffraction peaks at each Bragg angle (2θ±0.2) of 9.3°, 10.6°, 13.2°, 15.1°, 15.7°, 16.1°, 20.8°, 23.3°, 26.30, and 27.1° in X-ray diffraction using a CuKα line. Then, 5 parts of poly(vinyl butylal) (trade name: Denka butyral #6000C, by TOKYO DENKI KAGAKU KOGYO KABUSHIKI KAISHA) was dissolved in 95 parts of 1,2-dimethoxyethane to prepare a binder solution 1 having a solid content of 5%. Subsequently, 5 parts of phenoxy resin (trade name: PKHH, by Union Carbide Corporation) was dissolved in 95 parts of 1,2-dimethoxyethane to prepare a binder solution 2 having a solid content of 5%. Next, 160 parts of the previously prepared pigment dispersion liquid, 50 parts of the binder solution 1, 50 parts of the binder solution 2, a suitable amount of 1,2-dimethoxyethane, a suitable amount of 4-methoxy-4-methylpentanone-2 were mixed with each other to prepare a dispersion liquid (α) for the charge generation layer having a solid content of 4.0% and a mixing ratio of 9:1 (=1,2-dimethoxyethane: 4-methoxy-4-methylpentanone-2).

The mirror-finished surface of an aluminum alloy cylinder having an outer diameter of 30 mm, a length of 285 mm, and a wall thickness of 1.0 mm was anodized, and was then sealed by a sealer having nickel acetate as the main component thereof to form an anodized film (alumite film) having a film thickness of about 6 μm. This cylinder was dip-coated with the previously prepared dispersion liquid (α) for a charge generation layer, and a charge generation layer was formed thereon such that it has a film thickness after drying of about 0.3 μm. Next, this cylinder having the charge generation layer previously formed thereon was dip-coated with the coating liquid for forming a charge transport layer to prepare a photoreceptor drum on which a charge transport layer having a film thickness after drying of 20 μm was provided. The coating liquid for forming a charge transport layer was prepared as a binder resin for a charge transport layer by dissolving 100 parts of each of the polyester resins shown in Table 2, 0.05 parts of silicone oil (trade name: KF96 by Shin-Etsu-Chemical Co. Ltd.), and 50 parts of the aforementioned charge transporting material 1 in the mixed solvent of tetrahydrofuran and toluene (tetrahydrofuran 80% by weight, toluene 20% by weight).

(Examples of Preparations of Polyester Resin)

Using the following preparation methods, 25 kinds of polyester resins (resins A to y) were prepared.

Example of Preparation 1 (Resin A)

23.02 g of sodium hydroxide and 940 mL of water were weighed out in a 1000 mL beaker, and stirred and dissolved. 49.55 g of bis(4-hydroxy-3-methylphenyl)methane (hereinafter BP-a) was added thereto, followed by stirring and dissolving. Subsequently, this alkaline aqueous solution was transferred to a 2 L reaction tank. 0.5749 g of benzyltriethylammonium chloride and 1.0935 g of 2,3,5-trimethylphenol were then sequentially added to the reaction tank. The mixed solution of 65.29 g of diphenyl ether 4,4'-dicarboxylic acid dichloride and 470 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 783 mL of dichloromethane was added, followed by further stirring for 7 hours. 8.35 mL of acetic acid was then added, followed by stirring for 30 minutes. Subsequently, stirring was stopped and an organic layer was separated. This organic layer was washed twice with 942 mL of 0.1 N aqueous sodium hydroxide solution, and then washed twice with 942 mL of 0.1 N aqueous hydrochloric acid solution. Furthermore, this organic layer was washed twice with 942 mL of water. The washed organic layer was poured to 6266 mL of methanol, thus obtaining a precipitate. The precipitate was taken out by means of filtration. Then the precipitate was dried and thus resin A was obtained. The following chemical structure shows the repeating units of the structure of resin A.

[Chemical formula 27]

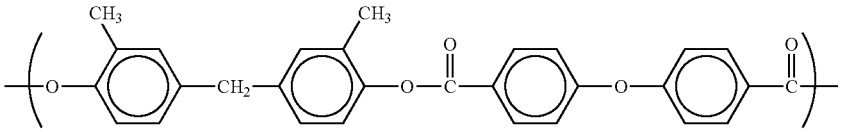

Example of Preparation 2 (Resin B)

26.01 g of sodium hydroxide and 846 mL of water were weighed out in a 1000 mL beaker, and stirred and dissolved. 56.00 g of BP-a was added thereto, followed by stirring and dissolving. Subsequently, this alkaline aqueous solution was transferred to a 2 L reaction tank. 0.6497 g of benzyltriethylammonium chloride and 1.2358 g of 2,3,5-trimethylphenol were then sequentially added to the reaction tank. Separately, the mixed solution of 50.78 g of terephthaloyl chloride and 423 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. As polymerization progressed, an insoluble element was produced in an organic layer. This made it impossible to take out and purify resin B. The following chemical structure shows the repeating units of the structure of resin B.

[Chemical formula 28]

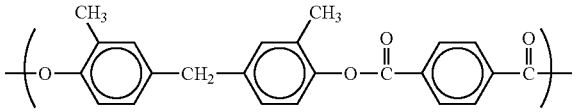

Example of Preparation 3 (Resin C)

10.81 g of sodium hydroxide and 423 mL of water were weighed out in a 500 mL beaker, and stirred and dissolved. 6.98 g of BP-a, and 14.28 g of the mixture (hereinafter, BP-e) of bis(4-hydroxyphenyl)methane (hereinafter, BP-b), (2-hydroxyphenyl)(4-hydroxyphenyl)methane (hereinafter, BP-c), and bis(2-hydroxyphenyl)methane (hereinafter, BP-d) (mixing ratio: about 35:48:17:BP-b; BP-c; BP-d) were added thereto, followed by stirring and dissolving. Subsequently, this alkaline aqueous solution was transferred to a 1 L reaction tank. 0.2699 g of benzyltriethylammonium chloride and 0.5662 g of p-(tert-butyl)phenol were then sequentially added to the reaction tank. Separately, the mixed solution of 30.65 g of diphenyl ether 4,4'-dicarboxylic acid dichloride and 211 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 352 mL of dichloromethane was added, followed by further stirring for 7 hours. 3.92 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of water. The washed organic layer was poured to 2820 mL of methanol to obtain a precipitate. The precipitate thus obtained was taken out by means of filtration. Then the precipitate was dried and thus resin C was obtained. The following chemical structure shows the repeating units of the structure of resin C.

[Chemical formula 29]

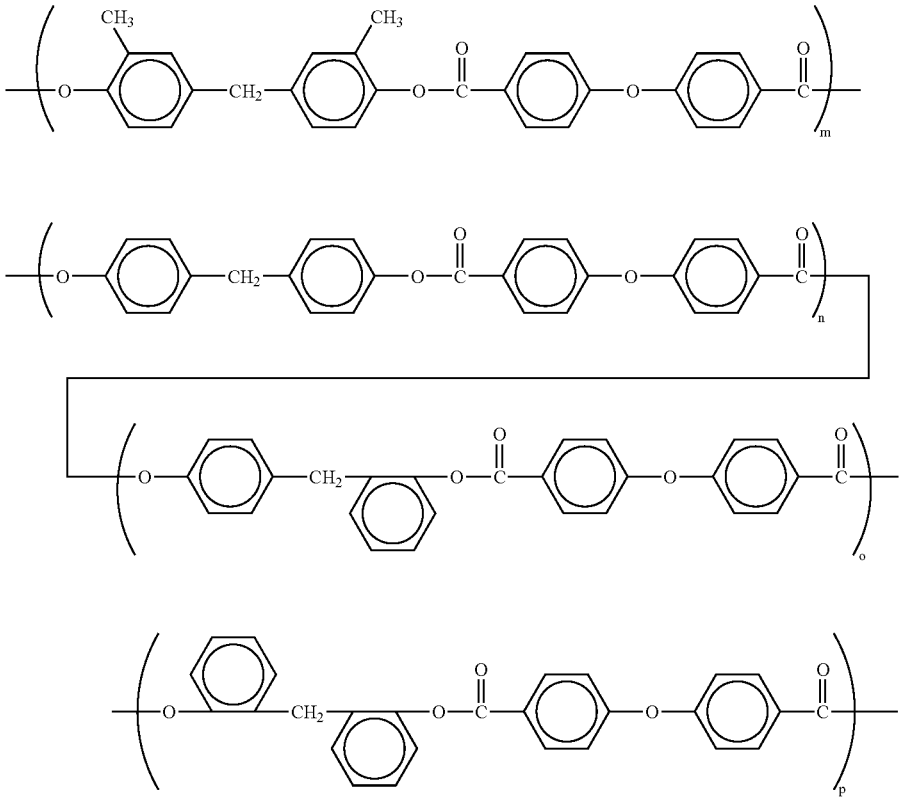

(m:n:o:p = 30:24.5:33.6:11.9)

Example of Preparation 4 (Resin D)

27.55 g of sodium hydroxide and 846 mL of water were weighed out in a 1000 mL beaker, and stirred and dissolved. 18.03 g of BP-a and 36.91 g of BP-e were added thereto, followed by stirring and dissolving. Subsequently, this alkaline aqueous solution was transferred to a 2 L reaction tank. 0.6792 g of benzyltriethylammonium chloride and 0.3585 g of 2,3,6-trimethylphenol were then sequentially added to the reaction tank. Separately, the mixed solution of 53.78 g of terephthaloyl chloride and 423 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. After stirring was continued for further 5 hours, 705 mL of dichloromethane was added, followed by further stirring for 5 hours. 9.99 mL of acetic acid was then added, followed by stirring for 30 minutes. Subsequently, stirring was stopped and an organic layer was separated. This organic layer was washed twice with 848 mL of 0.1 N aqueous sodium hydroxide solution, and then washed twice with 848 mL of 0.1 N aqueous hydrochloric acid solution. Furthermore, The organic layer was washed twice with 848 mL of water. The washed organic layer was poured to 5639 mL of methanol to obtain a precipitate. The precipitate thus obtained was taken out by means of filtration. Then the precipitate was dried and thus resin D was obtained. The following chemical structure shows the repeating units of the structure of resin D.

[Chemical formula 30]

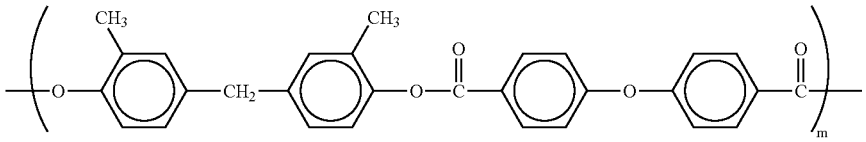

-continued

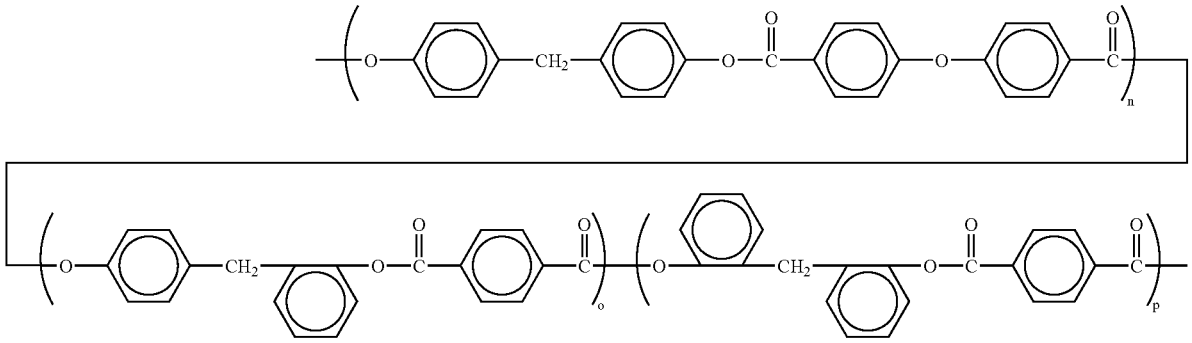

(m:n:o:p = 30:24.5:33.6:11.9)

Example of Preparation 5 (Resin E)

10.54 g of sodium hydroxide and 423 mL of water were weighed out in a 500 mL beaker, and stirred and dissolved. 15.88 g of BP-a, and 6.03 g of bis(4-hydroxyphenyl)ether (hereinafter, BP-f), were added thereto, followed by stirring and dissolving. Subsequently, this alkaline aqueous solution was transferred to a 1 L reaction tank. 0.2632 g of benzyltriethylammonium chloride and 0.5006 g of 2,3,5-trimethylphenol were then sequentially added to the reaction tank. Separately, the mixed solution of 29.89 g of diphenyl ether 4,4'-dicarboxylic acid dichloride and 211 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 352 mL of dichloromethane was added, followed by further stirring for 7 hours. 3.82 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of water. The washed organic layer was poured to 2820 mL of methanol to obtain a precipitate. The precipitate thus obtained was taken out by means of filtration. Then the precipitate was dried and thus resin E was obtained. The following chemical structure shows the repeating units of the structure of resin E.

Example of Preparation 6 (Resin F)

10.70 g of sodium hydroxide and 423 mL of water were weighed out in a 500 mL beaker, and stirred and dissolved. 14.15 g of BP-b, and 7.34 g of 1,1-bis(4-hydroxy-3-methylphenyl)ethane (hereinafter, BP-g) were added thereto, followed by stirring and dissolving. Subsequently, this alkaline aqueous solution was transferred to a 1 L reaction tank. 0.2674 g of benzyltriethylammonium chloride and 0.5609 g of p-(tert-butyl)phenol were then sequentially added to the reaction tank. Separately, the mixed solution of 30.36 g of diphenyl ether 4,4'-dicarboxylic acid dichloride and 211 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 352 mL of dichloromethane was added, followed by further stirring for 7 hours. 3.88 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of water. The washed organic layer was poured to 2820 mL of methanol. The precipitate thus obtained was taken out by means of filtration. Then the precipitate was dried and thus resin F was obtained. The following chemical structure shows the repeating units of the structure of resin F.

[Chemical formula 31]

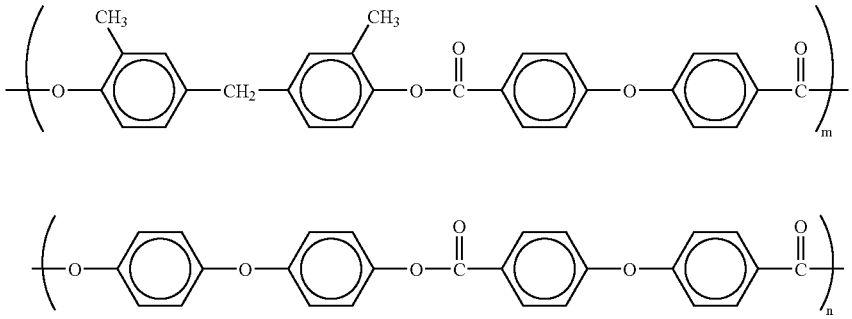

(m:n = 7:3)

[Chemical formula 32]

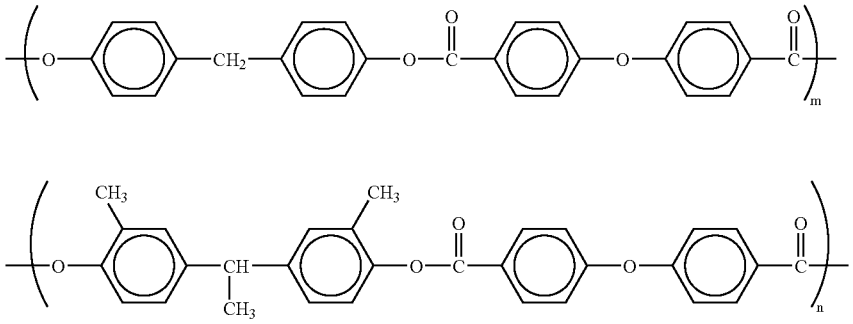

(m:n = 7:3)

Example of Preparation 7 (Resin G)

24.64 g of sodium hydroxide and 940 mL of water were weighed out in a 1000 mL beaker, and stirred and dissolved. 47.26 g of the mixture (hereinafter BP-h) of BP-b and BP-c (mixing ratio: about 40:60: BP-b; BP-c) was added thereto, followed by stirring and dissolving. Subsequently, this alkaline aqueous solution was transferred to a 2 L reaction tank. 0.6059 g of benzyltriethylammonium chloride and 0.1772 g of p-(tert-butyl)phenol were then sequentially added to the reaction tank. Separately, the mixed solution of 69.54 g of diphenyl ether 4,4'-dicarboxylic acid dichloride and 470 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 783 mL of dichloromethane was added, followed by further stirring for 7 hours. 8.93 mL of acetic acid was then added, followed by stirring for 30 minutes. Subsequently, stirring was stopped and an organic layer was separated. This organic layer was washed twice with 942 mL of 0.1 N aqueous sodium hydroxide solution, and then washed twice with 942 mL of 0.1 N aqueous hydrochloric acid solution. Furthermore, the organic layer was washed twice with 942 mL of water. The washed organic layer was poured to 6266 mL of methanol. The precipitate thus obtained was taken out by means of filtration. Then the precipitate was dried and thus resin G was obtained. The following chemical structure shows the repeating units of the structure of resin G.

Example of Preparation 8 (Resin H)

28.12 g of sodium hydroxide and 846 mL of water were weighed out in a 1000 mL beaker, and stirred and dissolved. 53.10 g of BP-h was added thereto, followed by stirring and dissolving. Subsequently, this alkaline aqueous solution was transferred to a 2 L reaction tank. 0.7024 g of benzyltriethylammonium chloride and 1.4736 g of p-(tert-butyl)phenol were then sequentially added to the reaction tank. Separately, the mixed solution of 54.90 g of terephthaloyl chloride and 423 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 705 mL of dichloromethane was added, followed by further stirring for 2 hours. 10.20 mL of acetic acid was then added, followed by stirring for 30 minutes. Subsequently, stirring was stopped and an organic layer was separated. This organic layer was washed twice with 848 mL of 0.1 N aqueous sodium hydroxide solution, and then washed twice with 848 mL of 0.1 N aqueous hydrochloric acid solution. Furthermore, the organic layer was washed twice with 848 mL of water. The washed organic layer was poured to 5639 mL of methanol. The precipitate thus obtained was taken out by means of filtration. Then the precipitate was dried and resin H was obtained. The following chemical structure shows the repeating units of the structure of resin H.

[Chemical formula 33]

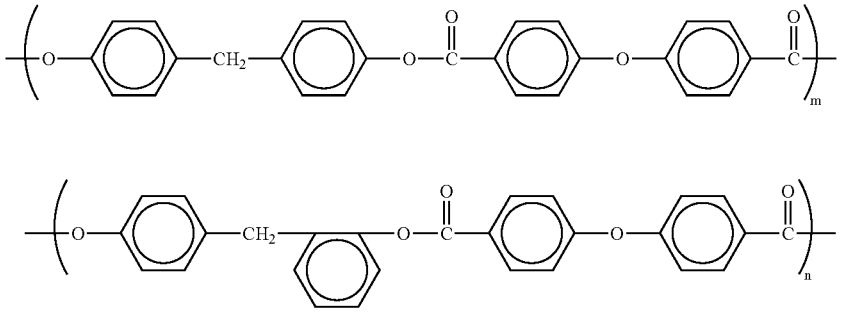

(m:n = 40:60)

[Chemical formula 34]

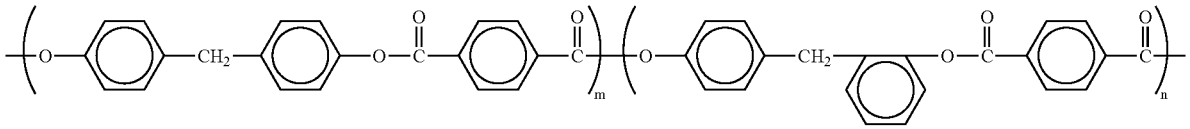

(m:n = 40:60)

Example of Preparation 9 (Resin I)

10.31 g of sodium hydroxide and 423 mL of water were weighed out in a 500 mL beaker, and stirred and dissolved. 16.49 g of BP-g and 5.90 g of BP-f were added thereto, followed by stirring and dissolving. Subsequently, this alkaline aqueous solution was transferred to a 1 L reaction tank. 0.2576 g of benzyltriethylammonium chloride and 0.4900 g of 2,3,5-trimethylphenol were then sequentially added to the reaction tank. Separately, the mixed solution of 29.26 g of diphenyl ether 4,4'-dicarboxylic acid dichloride and 211 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 352 mL of dichloromethane was added, followed by further stirring for 7 hours. 3.74 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of water. The washed organic layer was poured to 2820 mL of methanol. The precipitate thus obtained was taken out by means of filtration. Then the precipitate was dried to obtain resin I. The following chemical structure shows the repeating units of the structure of resin I.

Example of Preparation 10 (Resin J)

22.34 g of sodium hydroxide and 940 mL of water were weighed out in a 1000 mL beaker, and stirred and dissolved. 51.04 g of BP-g was added thereto, followed by stirring and dissolving. Subsequently, this alkaline aqueous solution was transferred to a 2 L reaction tank. 0.5579 g of benzyltriethylammonium chloride and 1.0613 g of 2,3,5-trimethylphenol were then sequentially added to the reaction tank. Separately, the mixed solution of 63.37 g of diphenyl ether 4,4'-dicarboxylic acid dichloride and 470 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 783 mL of dichloromethane was added, followed by further stirring for 7 hours. 8.10 mL of acetic acid was then added, followed by stirring for 30 minutes. Subsequently, stirring was stopped and an organic layer was separated. This organic layer was washed twice with 942 mL of 0.1 N aqueous sodium hydroxide solution, and then washed twice with 942 mL of 0.1 N aqueous hydrochloric acid solution. Furthermore, 942 mL of water was used twice to wash the organic layer. The washed organic layer was poured to 6266 mL of methanol. The precipitate thus obtained was taken out by means of filtration. Then the precipitate was dried to obtain resin J. The following chemical structure shows the repeating units of the structure of resin J.

[Chemical formula 35]

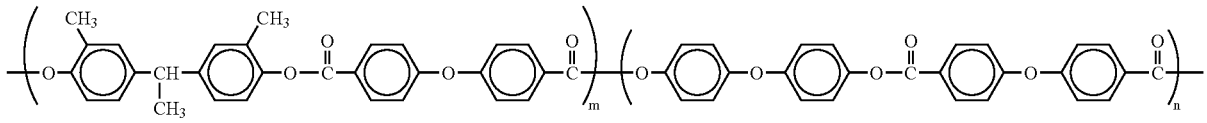

(m:n = 7:3)

[Chemical formula 36]

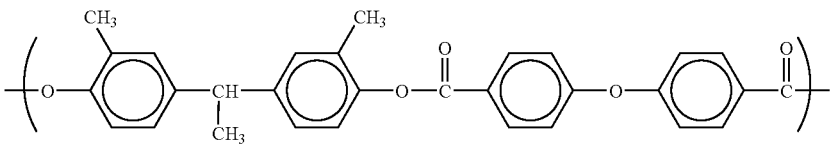

Example of Preparation 11 (Resin K)

23.71 g of sodium hydroxide and 940 mL of water were weighed out in a 1000 mL beaker, and stirred and dissolved. 47.91 g of 1,1-bis(4-hydroxyphenyl)ethane (hereinafter, BP-i) was added thereto, followed by stirring and dissolving. Subsequently, this alkaline aqueous solution was transferred to a 2 L reaction tank. 0.5923 g of benzyltriethylammonium chloride and 1.2425 g of p-(tert-butyl)phenol were then sequentially added to the reaction tank. Separately, the mixed solution of 67.27 g of diphenyl ether 4,4'-dicarboxylic acid dichloride and 470 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 783 mL of dichloromethane was added, followed by further stirring for 7 hours. 8.60 mL of acetic acid was then added, followed by stirring for 30 minutes. Subsequently, stirring was stopped and an organic layer was separated. This organic layer was washed twice with 942 mL of 0.1 N aqueous sodium hydroxide solution, and then washed twice with 942 mL of 0.1 N aqueous hydrochloric acid solution. Furthermore, the organic layer was washed twice with 942 mL of water. The washed organic layer was poured to 6266 mL of methanol. The precipitate thus obtained was taken out by means of filtration. Then the precipitate was dried to obtain resin K. The following chemical structure shows the repeating units of the structure of resin K.

[Chemical formula 37]

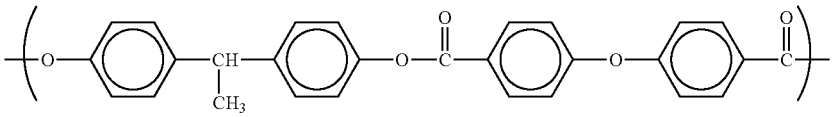

Example of Preparation 12 (Resin L)

13.52 g of sodium hydroxide and 423 mL of water were weighed out in a 500 mL beaker, and stirred and dissolved. 27.32 g of BP-i was added thereto, followed by stirring and dissolving. Subsequently, this alkaline aqueous solution was transferred to a 1 L reaction tank. 0.3378 g of benzyltriethylammonium chloride and 0.6425 g of 2,3,6-trimethylphenol were then sequentially added to the reaction tank. Separately, the mixed solution of 26.40 g of terephthaloyl chloride and 211 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. As polymerization progressed, an insoluble element was produced. This made it impossible to take out and purify resin L. The following chemical structure shows the repeating units of the structure of resin L.

[Chemical formula 38]

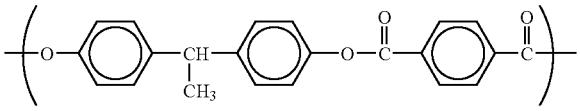

Example of Preparation 13 (Resin M)

25.06 g of sodium hydroxide and 846 mL of water were weighed out in a 1000 mL beaker, and stirred and dissolved. 57.25 g of BP-g was added thereto, followed by stirring and dissolving. Subsequently, this alkaline aqueous solution was transferred to a 2 L reaction tank. 0.6258 g of benzyltriethylammonium chloride and 1.1904 g of 2,3,6-trimethylphenol were then sequentially added to the reaction tank. Separately, the mixed solution of 48.91 g of terephthaloyl chloride and 423 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 705 mL of dichloromethane was added, followed by further stirring for 2 hours. 9.09 mL of acetic acid was then added, followed by stirring for 30 minutes. Subsequently, stirring was stopped and an organic layer was separated. This organic layer was washed twice with 848 mL of 0.1 N aqueous sodium hydroxide solution, and then washed twice with 848 mL of 0.1 N aqueous hydrochloric acid solution. Furthermore, the organic layer was washed twice with 848 mL of water. The washed organic layer was poured to 5639 mL of methanol. The precipitate thus obtained was taken out by means of filtration. Then the precipitate was dried and thus resin M was obtained. The following chemical structure shows the repeating units of the structure of resin M.

[Chemical formula 39]

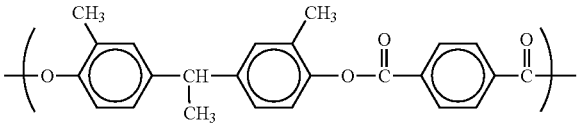

Example of Preparation 14 (Resin N)

10.85 g of sodium hydroxide and 470 mL of water were weighed out in a 500 mL beaker, and stirred and dissolved. 26.22 g of bis(4-hydroxy-3,5-dimethylphenyl)methane (hereinafter, BP-j) was added thereto, followed by stirring and dissolving. Subsequently, this alkaline aqueous solution was transferred to a 1 L reaction tank. 0.2710 g of benzyltriethylammonium chloride and 0.5154 g of 2,3,6-trimethylphenol were then sequentially added to the reaction tank. Separately, the mixed solution of 30.77 g of diphenyl ether 4,4'-dicarboxylic acid dichloride and 235 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 392 mL of dichloromethane was added, followed by further stirring for 7 hours. 3.93 mL of acetic acid was then added, followed by stirring for 30 minutes. Subsequently, stirring was stopped and an organic layer was separated. This organic layer was washed twice with 471 mL of 0.1 N aqueous sodium hydroxide solution, and then washed twice with 471 mL of 0.1 N aqueous hydrochloric acid solution. Furthermore, the organic layer was washed twice with 471 mL of water. The washed organic layer was poured to 3133 mL of methanol. The precipitate thus obtained was taken out by means of filtration. Then the precipitate was dried and thus resin N was obtained. The following chemical structure shows the repeating units of the structure of resin N.

[Chemical formula 40]

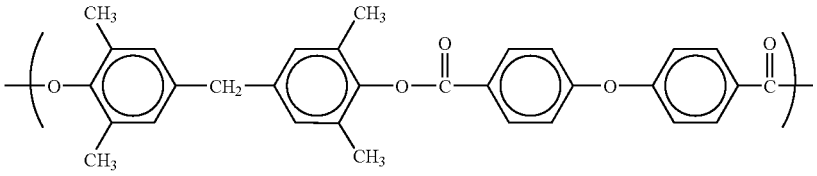

Example of Preparation 15 (Resin O)

7.25 g of sodium hydroxide and 600 mL of water were weighed out in a 1000 mL beaker, and stirred and dissolved. 17.39 g of BP-j was added thereto, followed by stirring and dissolving. Subsequently, this alkaline aqueous solution was transferred to a 1 L reaction tank. 0.0912 g of benzyltriethylammonium chloride and 0.4822 g of 2,3,6-trimethylphenol were then sequentially added to the reaction tank. Separately, the mixed solution of 14.15 g of terephthaloyl chloride and 300 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. 2.39 mL of acetic acid was then added, followed by stirring for 30 minutes. Subsequently, stirring was stopped and an organic layer was separated. This organic layer was washed twice with 339 mL of 0.1 N aqueous sodium hydroxide solution, and then washed twice with 339 mL of 0.1 N aqueous hydrochloric acid solution. Furthermore, the organic layer was washed twice with 339 mL of water. The washed organic layer was poured to 1500 mL of methanol. The precipitate thus obtained was taken out by means of filtration. Then the precipitate was dried and thus resin O was obtained. The following chemical structure shows the repeating units of the structure of resin O.

[Chemical formula 41]

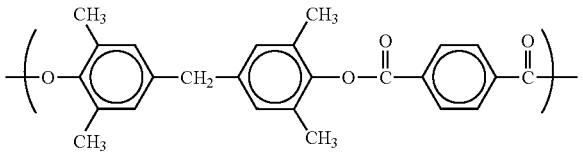

Example of Preparation 16 (Resin P)

9.52 g of sodium hydroxide and 470 mL of water were weighed out in a 500 mL beaker, and stirred and dissolved. 29.13 g of 1,1-bis(4-hydroxy-3,5-dimethylphenyl)cyclohexane (hereinafter, BP-k) was added thereto, followed by stirring and dissolving. Subsequently, this alkaline aqueous solution was transferred to a 1 L reaction tank. 0.2378 g of benzyltriethylammonium chloride and 0.4524 g of 2,3,6-trimethylphenol were then sequentially added to the reaction tank. Separately, the mixed solution of 27.01 g of diphenyl ether 4,4'-dicarboxylic acid dichloride and 235 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. Then, 392 mL of dichloromethane was added, followed by further stirring for 7 hours. 3.45 mL of acetic acid was then added, followed by stirring for 30 minutes. Subsequently, stirring was stopped and an organic layer was separated. This organic layer was washed twice with 471 mL of 0.1 N aqueous sodium hydroxide solution, and then washed twice with 471 mL of 0.1 N aqueous hydrochloric acid solution. Furthermore, the organic layer was washed twice with 471 mL of water. The washed organic layer was poured to 3133 mL of methanol. The precipitate thus obtained was taken out by means of filtration. Then the precipitate was dried and thus resin P was obtained. The following chemical structure shows the repeating units of the structure of resin P.

[Chemical formula 42]

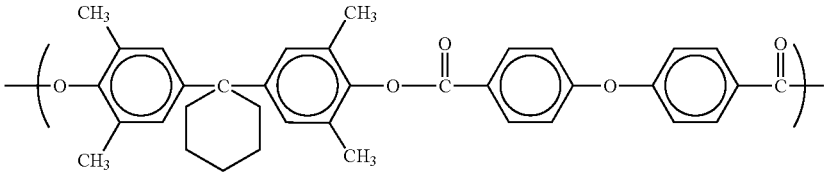

Example of Preparation 17 (Resin Q)

6.60 g of sodium hydroxide and 281 mL of water were weighed out in a 500 mL beaker, and stirred and dissolved. 17.65 g of BP-k was added thereto, followed by stirring and dissolving. Subsequently, this alkaline aqueous solution was transferred to a 1 L reaction tank. 0.0709 g of benzyltriethylammonium chloride and 0.1481 g of 2,3,6-trimethylphenol were then sequentially added to the reaction tank. Separately, the mixed solution of 11.17 g of terephthaloyl chloride and 281 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 6 hours. 3.46 mL of acetic acid was then added, followed by stirring for 30 minutes. Subsequently, stirring was stopped and an organic layer was separated. This organic layer was washed twice with 313 mL of 0.1 N aqueous sodium hydroxide solution, and then washed twice with 313 mL of 0.1 N aqueous hydrochloric acid solution. Furthermore, the organic layer was washed with 313 mL of water. The washed organic layer was poured to 1403 mL of methanol. The precipitate thus obtained was taken out by means of filtration. Then the precipitate was dried and thus resin Q was obtained. The following chemical structure shows the repeating units of the structure of resin Q.

[Chemical formula 43]

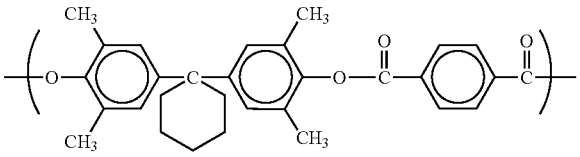

Example of Preparation 18 (Resin R)

13.29 g of sodium hydroxide and 423 mL of water were weighed out in a 500 mL beaker, and stirred and dissolved. 7.60 g of BP-f and 20.02 g of BP-a were added thereto, followed by stirring and dissolving. Subsequently, this alkaline aqueous solution was transferred to a 1 L reaction tank. 0.3319 g of benzyltriethylammonium chloride and 0.6314 g of 2,3,5-trimethylphenol were then sequentially added to the reaction tank. Separately, the mixed solution of 25.94 g of terephthaloyl chloride and 211 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. As polymerization progressed, an insoluble element was produced. This made it impossible to take out and purify resin R. The following chemical structure shows the repeating units of the structure of resin R.

[Chemical formula 44]

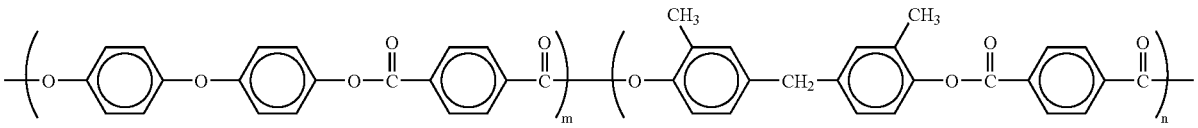

(m:n = 3:7)

Example of Preparation 19 (Resin S)

12.94 g of sodium hydroxide and 423 mL of water were weighed out in a 500 mL beaker, and stirred and dissolved. 7.40 g of BP-f and 20.69 g of BP-g were added thereto, followed by stirring and dissolving. Subsequently, this alkaline aqueous solution was transferred to a 1 L reaction tank. 0.3231 g of benzyltriethylammonium chloride and 0.6146 g of 2,3,5-trimethylphenol were then sequentially added to the reaction tank. The mixed solution of 25.25 g of terephthaloyl chloride and 211 mL of dichloromethane was separately transferred into an addition funnel. The dichloromethane solution was added dropwise to the alkaline aqueous solution in the reaction tank over 1 hour from the addition funnel, with stirring, while keeping the external temperature of the polymerization tank at 20° C. As polymerization progressed, an insoluble element was produced. This made it impossible to take out and purify resin S. The following chemical structure shows the repeating units of the structure of resin S.

[Chemical formula 45]

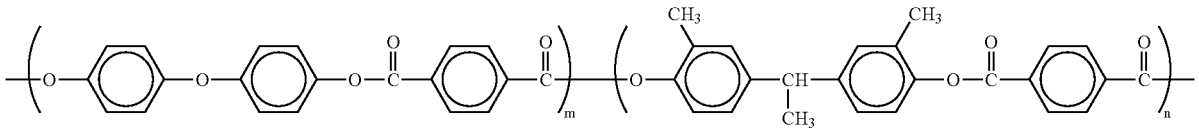

(m:n = 3:7)

Example of Preparation 20 (Resin T)

21.70 g of sodium hydroxide and 940 mL of water were weighed out in a 1000 mL beaker, and stirred and dissolved. 52.44 g of 2,2-bis(4-hydroxy-3-methylphenyl)propane (hereinafter BP-l) was added thereto, followed by stirring and dissolving. Subsequently, this alkaline aqueous solution was transferred to a 2 L reaction tank. 0.5419 g of benzyltriethylammonium chloride and 1.0308 g of 2,3,5-trimethylphenol were then sequentially added to the reaction tank. Separately, the mixed solution of 61.55 g of diphenyl ether 4,4'-dicarboxylic acid dichloride and 470 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. 783 mL of dichloromethane was added, followed by further stirring for 7 hours. 7.87 mL of acetic acid was then added, followed by stirring for 30 minutes. Subsequently, stirring was stopped and an organic layer was separated. This organic layer was washed twice with 942 mL of 0.1 N aqueous sodium hydroxide solution, and then washed twice with 942 mL of 0.1 N aqueous hydrochloric acid solution. Furthermore, the organic layer was washed twice with 942 mL of water. The washed organic layer was poured to 6266 mL of methanol. The precipitate thus obtained was taken out by means of filtration. Then the precipitate was dried and thus resin T was obtained. The following chemical structure shows the repeating units of the structure of resin T.

[Chemical formula 46]

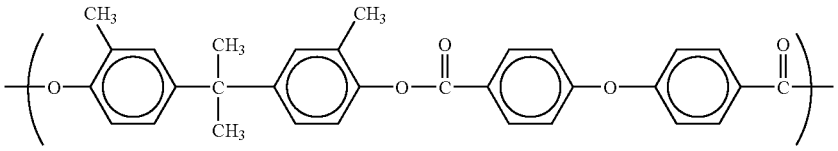

Example of Preparation 21 (Resin U)

12.08 g of sodium hydroxide and 423 mL of water were weighed out in a 500 mL beaker, and stirred and dissolved. 29.20 g of BP-l was added thereto, followed by stirring and dissolving. Subsequently, this alkaline aqueous solution was transferred to a 1 L reaction tank. 0.3018 g of benzyltriethylammonium chloride and 0.5741 g of 2,3,6-trimethylphenol were then sequentially added to the reaction tank. Separately, the mixed solution of 23.59 g of terephthaloyl chloride and 211 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. 352 mL of dichloromethane was added, followed by further stirring for 2 hours. 4.38 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of water. The washed organic layer was poured to 2820 mL of methanol. The precipitate thus obtained was taken out by means of filtration. Then the precipitate was dried and thus resin U was obtained. The following chemical structure shows the repeating units of the structure of resin U.

[Chemical formula 47]

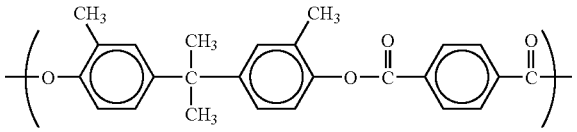

Example of Preparation 22 (Resin V)

10.58 g of sodium hydroxide and 470 mL of water were weighed out in a 500 mL beaker, and stirred and dissolved. 26.76 g of 1,1-bis(4-hydroxyphenyl)cyclohexane (hereinafter BP-m) was added thereto, followed by stirring and dissolving. Subsequently, this alkaline aqueous solution was transferred to a 1 L reaction tank. 0.2642 g of benzyltriethylammonium chloride and 0.5543 g of p-(tert-butyl)phenol were then sequentially added to the reaction tank. The mixed solution of 30.01 g of diphenyl ether 4,4'-dicarboxylic acid dichloride and 235 mL of dichloromethane was separately transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. 392 mL of dichloromethane was added, followed by further stirring for 7 hours. 3.84 mL of acetic acid was then added, followed by stirring for 30 minutes. Subsequently, stirring was stopped and an organic layer was separated. This organic layer was washed twice with 471 mL of 0.1 N aqueous sodium hydroxide solution, and then washed twice with 471 mL of 0.1 N aqueous hydrochloric acid solution. Furthermore, the organic layer was washed twice with 471 mL of water. The washed organic layer was poured to 3133 mL of methanol. The precipitate thus obtained was taken out by means of filtration. Then the precipitate was dried and thus resin V was obtained. The following chemical structure shows the repeating units of the structure of resin V.

[Chemical formula 48]

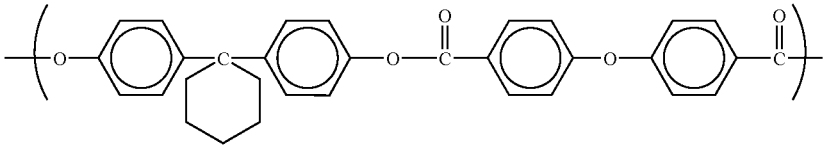

Example of Preparation 23 (Resin W)

4.62 g of sodium hydroxide and 400 mL of water were weighed out in a 500 mL beaker, and stirred and dissolved. 11.70 g of BP-m was added thereto, followed by stirring and dissolving. Subsequently, this alkaline aqueous solution was transferred to a 1 L reaction tank. 0.0583 g of benzyltriethylammonium chloride and 0.1987 g of p-(tert-butyl)phenol were then sequentially added to the reaction tank. Separately, the mixed solution of 9.46 g of terephthaloyl chloride and 200 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. As polymerization progressed, an insoluble element was produced. This made it impossible to take out and purify resin W. The following chemical structure shows the repeating units of the structure of resin W.

[Chemical formula 49]

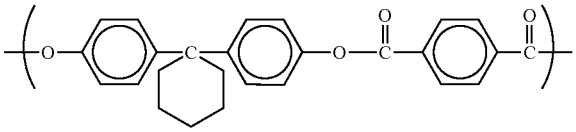

Example of Preparation 24 (Resin X)

22.99 g of sodium hydroxide and 940 mL of water were weighed out in a 1000 mL beaker, and stirred and dissolved. 49.49 g of 2,2-bis(4-hydroxyphenyl)propane (hereinafter, BP-n) was added thereto, followed by stirring and dissolving. Subsequently, this alkaline aqueous solution was transferred to a 2 L reaction tank. 0.5743 g of benzyltriethylammonium chloride and 1.2048 g of p-(tert-butyl)phenol were then sequentially added to the reaction tank. Separately, the mixed solution of 65.22 g of diphenyl ether 4,4'-dicarboxylic acid dichloride and 470 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. Stirring was continued for further 5 hours. 783 mL of dichloromethane was added, followed by further stirring for 7 hours. 8.34 mL of acetic acid was then added, followed by stirring for 30 minutes. Subsequently, stirring was stopped and an organic layer was separated. This organic layer was washed twice with 942 mL of 0.1 N aqueous sodium hydroxide solution, and then washed twice with 942 mL of 0.1 N aqueous hydrochloric acid solution. Furthermore, the organic layer was washed twice with 942 mL of water. The washed organic layer was poured to 6266 mL of methanol. The precipitate thus obtained was taken out by means of filtration. Then the precipitate was dried and thus resin X was obtained. The following chemical structure shows the repeating units of the structure of resin X.

[Chemical formula 50]

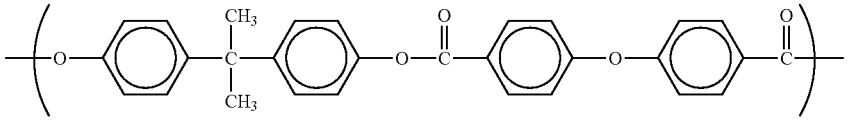

Example of Preparation 25 (Resin Y)

14.43 g of sodium hydroxide and 470 mL of water were weighed out in a 500 mL beaker, and stirred and dissolved. 31.06 g of BP-n was added thereto, followed by stirring and dissolving. Subsequently, this alkaline aqueous solution was transferred to a 1 L reaction tank. 0.3605 g of benzyltriethylammonium chloride and 0.7562 g of p-(tert-butyl)phenol were then sequentially added to the reaction tank. Separately, the mixed solution of 28.17 g of terephthaloyl chloride and 235 mL of dichloromethane was transferred into an addition funnel. The dichloromethane solution was added dropwise to the alkaline aqueous solution in the reaction tank over 1 hour from the addition funnel, with stirring, while keeping the external temperature of the polymerization tank at 20° C. As polymerization progressed, an insoluble element was produced. This made it impossible to take out and purify resin Y. The following chemical structure shows the repeating units of the structure of resin Y.

[Chemical formula 51]

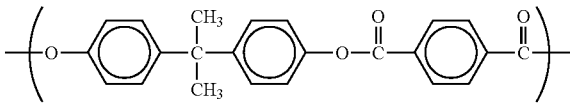

Examples 1 to 10

Comparative Examples 1 to 8

Tests of electric characteristics and wear resistance were carried out on photosensitive sheets prepared by using respective polyester resins as shown in Table 1. The results are shown in Table 1.

solvent generally used in coating liquid for forming a charge transport layer and high coating liquid stability. Therefore, it is also found that the photosensitive sheets (Examples 1 to 10) provided with a photosensitive layer containing at least one of these polyester resins exhibit good performance in the tests of electric characteristics and wear resistance.

On the contrary, the polyester resins (resins B, R, S, and W) containing terephthalic acid residue (TPA) in the molecule have an element insoluble in the solvent used for the coating liquid for forming a charge transport layer, and therefore cannot be used for preparing a photosensitive sheet. The photosensitive sheet provided with a photosensitive layer containing these polyester resins (comparative examples 2, 3, 4, and 7) can be seen not to exhibit satisfactory performance in the tests of electric characteristics and wear resistance.

TABLE 1

| | | RESIN | | COMPOSITION(COMPOSITION RATIO:MOLE RATIO) | | | ELECTRIC PROPERTIES VL | | WEAR |
|---|---|---|---|---|---|---|---|---|---|
| | | KIND | Mv | BIVALENT PHENOL RESIDUE | DI-CARBOXYLIC ACID RESIDUE | PHOTO-RECEPTOR SHEET | NN ENVIRONMENT (−V) | LL ENVIRONMENT (−V) | TEST WEAR (mg) |
| EXAMPLES | 1 | A | 58400 | BP-a(1) | ODBA(1) | A1 | 55 | 94 | 0.7 |
| | 2 | C | 21300 | BP-a(3)/BP-e(7) | ODBA(10) | C1 | 69 | 122 | 0.7 |
| | 3 | E | 29700 | BP-a(7)/BP-f(3) | ODBA(10) | E1 | 42 | 90 | 0.4 |
| | 4 | F | 44800 | BP-b(7)/BP-g(3) | ODBA(10) | F1 | 76 | 131 | 0.1 |
| | 5 | I | 36000 | BP-g(7)/BP-f(3) | ODBA(10) | I1 | 36 | 73 | 0.1 |
| | 6 | J | 51700 | BP-g(1) | ODBA(1) | J1 | 67 | 105 | 0.4 |
| | 7 | N | 53500 | BP-j(1) | ODBA(1) | N1 | 92 | 141 | 1.1 |
| | 8 | P | 31200 | BP-k(1) | ODBA(1) | P1 | 67 | 103 | 3.6 |
| | 9 | T | 50100 | BP-l(1) | ODBA(1) | T1 | 57 | 96 | 0.3 |
| | 10 | V | 37800 | BP-m(1) | ODBA(1) | V1 | 101 | 148 | 0.1 |
| COMPARATIVE EXAMPLES | 1 | B | — | BP-a(1) | TPA(1) | B1 | INSOLUBLE | INSOLUBLE | INSOLUBLE |
| | 2 | D | 47500 | BP-a(3)/BP-e(7) | TPA(10) | D1 | PEELED | PEELED | PEELED |
| | 3 | O | 33300 | BP-j(1) | TPA(1) | O1 | 98 | 148 | 2.2 |
| | 4 | Q | 43400 | BP-k(1) | TPA(1) | Q1 | 92 | 141 | 4.0 |
| | 5 | R | — | BP-f(3)/BP-a(7) | TPA(10) | R1 | INSOLUBLE | INSOLUBLE | INSOLUBLE |
| | 6 | S | — | BP-f(3)/BP-g(7) | TPA(10) | S1 | INSOLUBLE | INSOLUBLE | INSOLUBLE |
| | 7 | U | 52400 | BP-l(1) | TPA(1) | U1 | 93 | 143 | 3.9 |
| | 8 | W | — | BP-m(1) | TPA(1) | W1 | INSOLUBLE | INSOLUBLE | INSOLUBLE |

Note that, compounds represented by the abbreviations in Table 1 are as follows.

ODBA: Diphenyl ether 4,4'-dicarboxylic acid residue

TPA: Terephthalic acid residue

BP-a: Bis(4-hydroxy-3-methylphenyl)methane

BP-b: Bis(4-hydroxyphenyl)methane

BP-e: Mixture of bis(4-hydroxyphenyl)methane, (2-hydroxyphenyl)(4-hydroxyphenyl) methane, and bis(2-hydroxyphenyl)methane (mixing ratio: about 35:48:17, respectively)

BP-f: Bis(4-hydroxyphenyl)ether

BP-g: 1,1-Bis(4-hydroxy-3-methylphenyl)ethane

BP-j: Bis(4-hydroxy-3,5-dimethylphenyl)methane

BP-k: 1,1-Bis(4-hydroxy-3,5-dimethylphenyl)cyclohexane

BP-l: 2,2-Bis(4-hydroxy-3-methylphenyl)propane

BP-m: 1,1-Bis(4-hydroxyphenyl)cyclohexane

From the results shown in Table 1, it is found that the polyester resins, which contain diphenyl ether 4,4'-dicarboxylic acid residue (ODBA), and which have the repeating units respectively represented by the aforementioned general formulae 1 to 5 in the molecule, exhibit high solubility in the Examples 11 to 17

Comparative examples 9 to 13

A printing resistance test was carried out on each photoreceptor drum prepared by using each one of polyester resins as shown in Table 2. The results are shown in Table 2.

TABLE 2

| | | RESIN | | COMPOSITION (COMPOSITION RATIO:MOLE RATIO) | | PHOTORECEPTOR | PRINTING RESISTANCE TEST REDUCTION |
|---|---|---|---|---|---|---|---|
| | | KIND | Mv | BIVALENT PHENOL RESIDUE | DICARBOXYLIC ACID RESIDUE | DRUM | IN FILM (μm/10,000 sheets) |
| EXAMPLE | 11 | A | 58400 | BP-a(1) | ODBA(1) | A2 | 0.31 |
| | 12 | C | 21300 | BP-a(3)/BP-e(7) | ODBA(10) | C2 | 0.59 |
| | 13 | G | 28700 | BP-h(1) | ODBA(1) | G2 | 0.63 |
| | 14 | J | 51700 | BP-g(1) | ODBA(1) | J2 | 0.41 |
| | 15 | K | 48000 | BP-i(1) | ODBA(1) | K2 | 0.68 |
| | 16 | T | 50100 | BP-l(1) | ODBA(1) | T2 | 0.52 |
| | 17 | X | 45900 | BP-n(1) | ODBA(1) | X2 | 0.76 |
| COMPARATIVE EXAMPLE | 9 | B | — | BP-a(1) | TPA(1) | B2 | INSOLUBLE |
| | 10 | H | 46000 | BP-h(1) | TPA(1) | H2 | 1.15 |
| | 11 | L | — | BP-i(1) | TPA(1) | L2 | INSOLUBLE |
| | 12 | M | 54200 | BP-g(1) | TPA(1) | M2 | 0.46 |
| | 13 | Y | — | BP-n(1) | TPA(1) | Y2 | INSOLUBLE |

Note that, compounds represented by the abbreviations in Table 2 are as follows.
ODBA: Diphenyl ether 4,4'-dicarboxylic acid residue
TPA: Terephthalic acid residue
BP-a: Bis(4-hydroxy-3-methylphenyl)methane
BP-e: Mixture of bis(4-hydroxyphenyl)methane, (2-hydroxyphenyl)(4-hydroxyphenyl) methane, and bis(2-hydroxyphenyl)methane (mixing ratio: 35:48:17, respectively)
BP-g: 1,1-Bis(4-hydroxy-3-methylphenyl)ethane
BP-h: Mixture of bis(4-hydroxyphenyl)methane, and (2-hydroxyphenyl)(4-hydroxyphenyl)methane (mixing ratio: about 40:60, respectively)
BP-i: 1,1-Bis(4-hydroxyphenyl)ethane
BP-l: 2,2-Bis(4-hydroxy-3-methylphenyl)propane
BP-n: 2,2-Bis(4-hydroxyphenyl)propane From the results shown in Table 2, it is found that photoreceptor drums (Examples 11 to 17) provided with a photosensitive layer containing at least one of polyester resins, which contain diphenyl ether 4,4'-dicarboxylic acid residue (ODBA), and which have the repeating units respectively represented by the aforementioned general formulae 1 to 5 in the molecule, exhibit high performance in a printing resistance test.

On the contrary, the polyester resins (resins B, L, and Y) containing terephthalic acid residue (TPA) in the molecule have an element insoluble in the solvent used in the coating liquid for forming a charge transport layer, and therefore cannot be used to prepare a photoreceptor drum. The photoreceptor drums (comparative examples 10 and 12) provided with a photosensitive layer containing these polyester resins can be seen not to exhibit satisfactory performance in the printing resistance test.

Regarding the photoreceptor drums J2 and M2 respectively prepared as Example 14 and Comparative example 12, measurements of the difference in potential between areas thereof exposed and unexposed to light of a white fluorescent lamp were carried out as follows. The entire surface of each of the photoreceptor drums J2 and M2 was covered with a black paper having a rectangular opening 20 mm high and 40 mm wide and thus both areas exposed and not exposed to the light of the white fluorescent lamp were created on the surfaces thereof. The light of a white fluorescent lamp (Neolumisuper FL20SS by MITSUBISHI ELECTRIC OSRAM Ltd.) was then irradiated thereon focusing around the opening portion of the black paper for 10 minutes, the light of the white fluorescent lamp being adjusted so as to cause the light intensity thereof to be 2000 luxes. After the 10 minutes irradiation, the black paper was removed from the surface of the drum and the drum was provided on an electric characteristic tester and the difference in electric potential between the areas exposed and not exposed was measured. The results are shown in the Table 3.

TABLE 3

| | PHOTORECEPTOR | POTENTIAL OF DARK AREA (−V) | | | POTENTIAL OF LIGHT AREA (−V) | | |
|---|---|---|---|---|---|---|---|
| | | EXPOSED AREA | UNEXPOSED AREA | DIFFERENCE IN POTENTIAL | EXPOSED AREA | UNEXPOSED AREA | DIFFERENCE IN POTENTIAL |
| EXAMPLE 14 | J2 | 700 | 678 | 7 | 170 | 144 | 9 |
| COMPARATIVE EXAMPLE 12 | M2 | 700 | 648 | 17 | 170 | 82 | 91 |

From the results shown in Table 3, it is found that the photoreceptor J2 of Example 14 secures light resistance which is an important property for an electrophotographic photoreceptor. On the other hand, it is found that the photoreceptor M2 of Comparative Example 12 is too poor in light resistance to be put into practice, while exhibiting less reduction in the amount of the film in the printing resistance test.

By the following preparation methods, five polyester resins (resins JA to JE) were prepared.

Example of Preparation 26 (Resin JA)

10.15 g of sodium hydroxide and 423 mL of $H_2O$ were weighed out in a 500 mL beaker, and stirred and dissolved. Then, 23.01 g of BP-g was added thereto, followed by stirring and dissolving. Subsequently, this alkaline aqueous solution was transferred to a 1 L reaction tank. 0.2552 g of benzyltriethylammonium chloride and 0.6725 g of 2,3,5-trimethylphenol were then sequentially added to the reaction tank.

Separately, the mixed solution of 28.20 g of diphenyl ether 4,4'-dicarboxylic acid dichloride and 211 mL of dichloromethane was transferred into an addition funnel.

The dichloromethane solution was added dropwise to the alkaline aqueous solution in the reaction tank over 1 hour from the addition funnel, with stirring, while keeping the external temperature of the polymerization tank at 20° C. Stirring was continued for further 4 hours. 352 mL of dichloromethane was then added, followed by further stirring for 6 hours. 3.68 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed four times with 424 mL of 0.1 N aqueous hydrochloric acid solution. Furthermore, the organic layer was washed twice with 424 mL of $H_2O$. The organic solvent in the organic layer was removed and thus resin JA was obtained. The viscosity-average molecular weight of the obtained resin JA was 41,000. The repeating unit of the structure of the resin JA is the same as that of resin J obtained in Example of preparation 10, and is therefore omitted here.

Example of Preparation 27 (Resin JB)

10.14 g of sodium hydroxide and 423 mL of $H_2O$ were weighed out in a 500 mL beaker, and stirred and dissolved. Then, 22.75 g of BP-g was added thereto, followed by stirring and dissolving. Subsequently, this alkaline aqueous solution was transferred to a 1 L reaction tank. 0.2576 g of benzyltriethylammonium chloride and 0.9462 g of 2,3,5-trimethylphenol were then sequentially added to the reaction tank.

Separately, the mixed solution of 28.19 g of diphenyl ether 4,4'-dicarboxylic acid dichloride and 211 mL of dichloromethane was transferred into an addition funnel.

The dichloromethane solution was added dropwise to the alkaline aqueous solution in the reaction tank over 1 hour from the addition funnel, with stirring, while keeping the external temperature of the polymerization tank at 20° C. Stirring was continued for further 4 hours. 352 mL of dichloromethane was then added, followed by further stirring for 6 hours. 3.68 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of $H_2O$. The washed organic layer was poured to 2820 mL of methanol and thus a precipitate was obtained. The precipitate was taken out by means of filtration. Then the precipitate was dried and thus resin JB was obtained. The viscosity-average molecular weight of the resin JB is 31,500. Note that, the repeating units of the resin JB is the same as that of resin J obtained in Example of preparation 10, and is therefore omitted here.

Example of Preparation 28 (Resin JC)

10.14 g of sodium hydroxide and 423 mL of $H_2O$ were weighed out in a 500 mL beaker, and stirred and dissolved. Then, 22.75 g of BP-g was added thereto, followed by stirring and dissolving. Subsequently, this alkaline aqueous solution was transferred to a 1 L reaction tank. 0.2576 g of benzyltriethylammonium chloride and 0.9462 g of 2,3,5-trimethylphenol were then sequentially added to the reaction tank.

Separately, the mixed solution of 28.19 g of diphenyl ether 4,4'-dicarboxylic acid dichloride and 211 mL of dichloromethane was transferred into an addition funnel.

The dichloromethane solution was added dropwise to the alkaline aqueous solution in the reaction tank over 1 hour from the addition funnel, with stirring, while keeping the external temperature of the polymerization tank at 20° C. Stirring was continued for further 4 hours. 352 mL of dichloromethane was then added, followed by further stirring for 6 hours. 3.68 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed four times with 424 mL of 0.1 N aqueous hydrochloric acid solution. Furthermore, the organic layer was washed twice with 424 mL of $H_2O$. The organic solvent in the organic layer was removed and thus resin JC was obtained. The viscosity-average molecular weight of the obtained resin JC was 31,500. The repeating unit of the structure of resin JC is the same as that of resin J obtained in Example of preparation 10, and is therefore omitted here.

Example of Preparation 29 (Resin JD)

10.15 g of sodium hydroxide and 423 mL of $H_2O$ were weighed out in a 500 mL beaker, and stirred and dissolved. Then, 23.01 g of BP-g was added thereto, followed by stirring and dissolving. Subsequently, this alkaline aqueous solution was transferred to a 1 L reaction tank. 0.2552 g of benzyltriethylammonium chloride and 0.6725 g of 2,3,5-trimethylphenol were then sequentially added to the reaction tank.

Separately, the mixed solution of 28.20 g of diphenyl ether 4,4'-dicarboxylic acid dichloride and 211 mL of dichloromethane was transferred into an addition funnel.

The dichloromethane solution was added dropwise to the alkaline aqueous solution in the reaction tank over 1 hour from the addition funnel, with stirring, while keeping the external temperature of the polymerization tank at 20° C. Stirring was continued for further 4 hours. 352 mL of dichloromethane was then added, followed by further stirring for 6 hours. Subsequently, stirring was stopped and an organic layer was separated. This organic layer was washed four times with 424 mL of 0.1 N aqueous hydrochloric acid solution. Furthermore, the organic layer was washed twice with 424 mL of $H_2O$. The organic solvent in the organic layer was removed and thus resin JD was obtained. The viscosity-average molecular weight of the obtained resin JD was 41,000. The repeating unit of the structure of resin JD is the same as that of resin J obtained in Example of preparation 10, and is therefore omitted here.

Example of Preparation 30 (Resin JE)

10.14 g of sodium hydroxide and 423 mL of $H_2O$ were weighed out in a 500 mL beaker, and stirred and dissolved. Then, 22.75 g of BP-g was added thereto, followed by stirring and dissolving. Subsequently, this alkaline aqueous solution was transferred to a 1 L reaction tank. 0.2576 g of benzyltriethylammonium chloride and 0.9462 g of 2,3,5-trimethylphenol were then sequentially added to the reaction tank.

Separately, the mixed solution of 28.19 g of diphenyl ether 4,4'-dicarboxylic acid dichloride and 211 mL of dichloromethane was transferred into an addition funnel.

The dichloromethane solution was added dropwise to the alkaline aqueous solution in the reaction tank over 1 hour from the addition funnel, with stirring, while keeping the external temperature of the polymerization tank at 20° C. Stirring was continued for further 4 hours. 352 mL of dichloromethane was then added, followed by further stirring for 6 hours. Subsequently, stirring was stopped and an organic layer was separated. This organic layer was washed four times with 424 mL of 0.1 N aqueous hydrochloric acid solution. Furthermore, the organic layer was washed twice with 424 mL of $H_2O$. The organic solvent in the organic layer was removed and thus resin JE was obtained. The viscosity-average molecular weight of the obtained resin JE was 31,500. The repeating unit of the structure of resin JE is the same as that of resin J obtained in Example of preparation 10, and is therefore omitted here.

The dispersion liquid for a subbing layer was produced as follows. That is, rutile type titanium dioxide (TTO55N by ISHIHARA SANGYO Co. Ltd.) having an average primary particle diameter of 40 nm, and methyldimethoxysilane (TSL8117 by GE Toshiba Silicone Co. Ltd.) that is 3% by weight based on this titanium dioxide were put in a high speed flow mixing-and-kneading machine (SMG300 by KAWATA MFG Co. Ltd.), and mixed at high revolutional circumferential velocity of 34.5 m/sec to obtain a titanium dioxide surface finisher. The obtained titanium dioxide surface finisher was dispersed in a mixed solvent of methanol and 1-propanol using a ball mill to obtain dispersion slurry of a hydrophobic titanium dioxide surface finisher. This dispersion slurry, the mixed solvent of methanol, 1-propanol and toluene, and a pellet of copolymerized polyamide having a composition mole ratio of 75:9.5:3:9.5:3: ϵ-caprolactam; bis(4-amino-3-methylcyclohexyl)methane; hexamethylenediamine; decamethylene dicarboxylate; octadecamethylene dicarboxylate were stirred, followed by mixing, while heating them to dissolve the polyamide pellet. Then, the solution was subjected to ultrasonic wave dispersion treatment to obtain a dispersion liquid for a subbing layer containing the mixed solvent having a weight ratio of 7:1:2:methanol; 1-propanol; toluene, and a solid content of 18% having hydrophobic titanium dioxide surface finisher and copolymerized polyamide in weight ratio of 3:1, respectively.

(Preparation of a Dispersion Liquid for a Charge Generation Layer)

10 parts by weight of oxytitanium phthalocyanine which exhibits the maximum diffraction peak at a Bragg angle (2θ±0.2) of 27.3° in X-ray diffraction using a CuKα line was added to 150 parts by weight of 1,2-dimethoxyethane. The mixture was milled for dispersion using a sand grind mill to prepare pigment dispersion liquid.

100 parts by weight of a binder solution having a solid content of 5% by weight which was prepared by dissolving 5 parts by weight of poly(vinyl butylal) (trade name: Denka butyral #6000C, by TOKYO DENKI KAGAKU KOGYO KABUSHIKI KAISHA) in 95 parts by weight of 1,2-dimethoxyethane, a suitable amount of 1,2-dimethoxyethane, and a suitable amount of 4-methoxy-4-methyl-2-pentanone were added to 160 parts by weight of this pigment dispersion liquid to produce a dispersion liquid β1 for a charge generation layer having a solid content of 4.0% by weight and constituted of 1,2-dimethoxyethane and 4-methoxy-4-methyl-2-pentanone in their mixing ratio of 9:1, respectively.

10 parts by weight of oxytitanium phthalocyanine which exhibits strong diffraction peaks at each Bragg angle (2θ±0.2) of 9.3°, 10.6°, 13.2°, 15.1°, 15.7°, 16.1°, 20.8°, 23.3°, 26.3°, and 27.1° in X-ray diffraction using a CuKα line was added to 150 parts by weight of 1,2-dimethoxyethane, and milled for dispersion by using a sand grind mill to prepare a pigment dispersion liquid. 100 parts by weight of a binder solution having a solid content of 5% by weight which was prepared by dissolving 5 parts by weight of poly(vinyl butylal) (trade name: Denka butyral #6000C, by TOKYO DENKI KAGAKU KOGYO KABUSHIKI KAISHA) in 95 parts by weight of 1,2-dimethoxyethane, a suitable amount of 1,2-dimethoxyethane, and a suitable amount of 4-methoxy-4-methyl-2-pentanone were added to 160 parts by weight of this pigment dispersion liquid to prepare a dispersion liquid β2 for a charge generation layer having a solid content of 4.0% by weight and constituted of 1,2-dimethoxyethane and 4-methoxy-4-methyl-2-pentanone in a mixing ratio of 9:1.

The dispersion liquids β1 and β2 for a charge generation layer were mixed in a mixing ratio of 8:2 to prepare a dispersion liquids β for a charge generation layer.

(Preparation of Photoreceptor)

Example 18

An aluminum alloy cylinder having an coarsely machined surface (Rmax: 0.8), an outer diameter of 30 mm, a length of 254 mm, and a wall thickness of 0.75 mm was dip-coated with the previously prepared dispersion liquid for a subbing layer, and a subbing layer was formed thereon, the subbing layer having a film thickness of about 1.3 μm. This cylinder was dip-coated with the previously prepared dispersion liquid β for a charge generation layer, and thus, a charge generation layer was formed thereon such that the weight of the film after drying was to be 0.3 g/$m^2$ (film thickness: 0.3 μm).

Then, this cylinder, on the surface of which a charge generation layer was formed, was dip-coated with a liquid prepared by dissolving 50 parts by weight of a charge transporting material constituted of an isomer mixture containing the aforementioned charge transporting material 1 as the main component, 100 parts by weight of the polyester resin (resin G) prepared in Example of preparation 7 as a binder resin for a charge transport layer, and 0.05 parts by weight of silicone oil (trade mark: KF96, by Shin-Etsu-Chemical Co. Ltd.) in 640 parts by weight of a mixed solvent of tetrahydrofuran and toluene (80% by weight of tetrahydrofuran and 20% by weight of toluene) to provide a charge transport layer having a film thickness after drying of 25 μm thereon. The photoreceptor drum thus obtained was designated by G3.

Comparative Example 14

Photoreceptor drum H3 was prepared in the same manner as Example 18 except that the polyester resin in Example of preparation 8 (resin H) was used.

Example 19

Photoreceptor drum J3 was prepared in the same manner as Example 18 except that the polyester resin in Example of preparation 10 (resin J) was used.

Example 20

Photoreceptor drum K3 was prepared in the same manner as Example 18 except that the polyester resin in Example of preparation 11 (resin K) was used.

Comparative Example 15

Photoreceptor drum M3 was prepared in the same manner as Example 18 except that the polyester resin in Example of preparation 13 (resin M) was used.

These photoreceptors G3, H3, J3, K3, and M3 were provided on a commercially available monochrome laser printer (Optra S2450 which is manufactured by Lexmark International, Inc., which can print 24 sheets per minute of A4-sized paper in portrait orientation, which is charged on the DC application roller by applying DC, and which uses a roller transfer system), and 30,000 sheets were printed at normal temperature and in normal humidity. The reduction in the amount of the applied film per 10,000 sheet printing was calculated from the difference in film thickness between before and after printing. Table 4 shows the results.

TABLE 4

| | | RESIN | | | PRINTING RESISTANCE TEST |
|---|---|---|---|---|---|
| | | KIND | AVERAGE MOLECULAR WEIGHT (Mv) | PHOTORECEPTOR DRUM | REDUCTION IN FILM (μm/10,000 sheets) |
| EXAMPLE | 18 | G | 28700 | G3 | 0.75 |
| | 19 | J | 51700 | J3 | 0.52 |
| | 20 | K | 48000 | K3 | 0.61 |
| COMPARATIVE | 14 | H | 46000 | H3 | 1.29 |
| EXAMPLE | 15 | M | 54200 | M3 | 0.82 |

It can be found from the results shown in Table 4 that the photoreceptors G3, J3, and K3 incur little wear in the printing resistance test, and thus have good printing resistance.

Example 21

The surface of an aluminum alloy cylinder having a coarsely machined surface (Rmax: 1.0), an outer diameter of 30 mm, a length of 346 mm, and a wall thickness of 1.0 mm was anodized, and then sealed by a sealer containing nickel acetate as the main component, thus forming an anodized film (alumite) having a film thickness of about 6 μm.

This cylinder was dip-coated with the previously prepared dispersion liquid for forming a subbing layer and a subbing layer having a film thickness after drying of about 1.3 μm was formed. Furthermore, this cylinder was dip-coated with the previously prepared dispersion liquid β1 for a charge generation layer, and thus a charge generation layer was formed such that the weight of the layer after drying was to be 0.3 g/m$^2$ (film thickness: about 0.3 μm).

Then, this cylinder, on the surface of which a charge generation layer was formed, was dip-coated with a liquid prepared by dissolving 30 parts by weight of a charge transporting material composed of an isomer mixture containing the aforementioned charge transporting material 1 as the main component, 4 parts by weight of antioxidant (Irganox 1076, by Ciba-Geigy Ltd.), 100 parts by weight of the polyester resin (resin J) prepared in Example of preparation 10 as a binder resin for a charge transport layer, and 0.05 parts by weight of silicone oil (trade mark: KF96, by Shin-Etsu-Chemical Co. Ltd.) in 640 parts by weight of a mixed solvent of tetrahydrofuran and toluene (80% by weight of tetrahydrofuran and 20% by weight of toluene) to provide a charge transport layer having a film thickness after drying of 25 μm thereon. The photoreceptor drum thus obtained was designated by J4.

Comparative Example 16

Photoreceptor drum M4 was prepared in the same manner as in Example 21 except that the polyester resin in Example of preparation 13 (resin M) was used.

Example 22

Photoreceptor drum J4A was prepared in the same manner as in Example 21 except that the polyester resin used was changed to resin JA which was constituted of the same repeating units as those of resin J, and had a viscosity-average molecular weight Mv of 41,000.

Example 23

Photoreceptor drum J4B was prepared in the same manner as in Example 21 except that the polyester resin used was changed to resin JB which was constituted of the same repeating units as those of resin J, and had a viscosity-average molecular weight Mv of 31,500.

Comparative Example 17

Photoreceptor drum Z4 was prepared in the same manner as in Example 21 except that polycarbonate resin (PCZ-400 having viscosity-average molecular weight Mv of about 40,000, by MITSUBISHI GAS CHEMICAL COMPANY INC.) constituted of bisphenol Z as a repeating units, was used instead of a polyester resin.

These photoreceptors J4, J4A, J4B, M4, and Z4 were provided on a commercially available digital imaging systems (WORKIO3200 which is by Panasonic Communications Co. Ltd., which can print 32 sheets per minute of A4-sized paper in landscape orientation, which is charged on the roller by applying AC-superimposed-on-DC voltage, which uses magnetic mono component jumping development system, and which has a resolution of 600 dpi×600 dpi), and 30,000 sheets were printed at normal temperature and in normal humidity. The reduction in the amount of the applied film per 10,000 sheet printing was calculated from the difference in film thickness between before and after printing. Table 5 shows the results.

TABLE 5

| | | RESIN | | | PRINTING RESISTANCE TEST |
|---|---|---|---|---|---|
| | | KIND | AVERAGE MOLECULAR WEIGHT (Mv) | PHOTORECEPTOR DRUM | REDUCTION IN FILM (μm/10,000 sheets) |
| EXAMPLE | 21 | J | 51700 | J4 | 0.94 |
| | 22 | JA | 41000 | J4A | 0.91 |
| | 23 | JB | 31500 | J4B | 0.90 |
| COMPARATIVE | 16 | M | 54200 | M4 | 1.62 |
| EXAMPLE | 17 | PCZ-400 | 40000 | Z4 | 2.87 |

It can be found from the results shown in Table 5 that the photoreceptors J4, J4A, and J4B incur little wear in the printing resistance test and thus have good printing resistance.

Example 24

An aluminum alloy cylinder having an coarsely machined surface (Rmax: 1.2), an outer diameter of 30 mm, a length of 350 mm, and a wall thickness of 1.0 mm was dip-coated with the previously prepared dispersion liquid for a subbing layer and a subbing layer having a film thickness of about 2 μm was formed thereon. This cylinder was further dip-coated with the previously prepared dispersion liquid β1 for a charge generation layer and a charge generation layer was formed thereon such that the weight of the film after drying was to be 0.3 g/m$^2$ (film thickness: 0.3 μm).

Then, this cylinder, on the surface of which a charge generation layer was formed, was dip-coated with a liquid prepared by dissolving 50 parts by weight of a charge transporting material composed of an isomer mixture containing the aforementioned charge transporting material 1 as the main component, 100 parts by weight of the polyester resin (resin A) prepared in Example of preparation 1 as a binder resin for a charge transport layer, and 0.05 parts by weight of silicone oil (trade mark: KF96, by Shin-Etsu-Chemical Co. Ltd.) in 640 parts by weight of a mixed solvent of tetrahydrofuran and toluene (80% by weight of tetrahydrofuran and 20% by weight of toluene) to provide a charge transport layer having a film thickness after drying of 26 μm thereon. The photoreceptor drum thus obtained was designated by A5.

Example 25

Photoreceptor drum J5A was prepared in the same manner as in Example 24 except that the polyester resin used was changed to resin JA which was constituted of the same repeating units as those of resin J, and had a viscosity-average molecular weight Mv of 41,000.

Comparative Example 18

Photoreceptor drum Z5 was prepared in the same manner as in Example 24 except that polycarbonate resin (PCZ-400 having viscosity-average molecular weight Mv of about 40,000, by MITSUBISHI GAS CHEMICAL COMPANY INC.) constituted of bisphenol Z as a repeating units, was used instead of polyester resin.

Comparative Example 19

Photoreceptor drum ZBp5 was prepared in the same manner as in Example 24 except that polycarbonate resin ZBp (viscosity-average molecular weight Mv of about 40,500) having the following formula was used instead of polyester resin.

[Chemical formula 52]

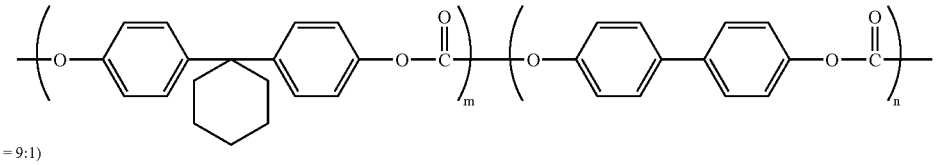

(m:n = 9:1)

These photoreceptors A5, J5A, Z5, and ZBp5 were provided on a commercially available digital combined printer (DiALTA Di350 which is by Minolta Co. Ltd., which can print 35 sheets per minute of A4-sized paper in landscape orientation, which is scorotron-charged, which uses two component development systems, and which has a resolution of 600 dpi×600 dpi) and 50,000 sheets were printed at normal temperature and in normal humidity. The reduction in the amount of the applied film per 10,000 sheet printing was calculated from the difference in film thickness between before and after printing. Table 6 shows the results.

TABLE 6

| | | RESIN | | | PRINTING RESISTANCE TEST |
|---|---|---|---|---|---|
| | | KIND | AVERAGE MOLECULAR WEIGHT (Mv) | PHOTORECEPTOR DRUM | REDUCTION IN FILM (μm/10,000 sheets) |
| EXAMPLE | 24 | A | 58400 | A5 | 0.32 |
| | 25 | JA | 41000 | J5A | 0.33 |
| COMPARATIVE | 18 | PCZ-400 | 40000 | Z5 | 0.94 |
| EXAMPLE | 19 | ZBp | 40500 | ZBp5 | 0.56 |

It can be found from the results shown in Table 6 that the photoreceptors A5 and J5A incur little wear in the printing resistance test and thus have good printing resistance.

Using the preparation method described below, six kinds of polyester resins (resins Z to ZE) were prepared.

The washed organic layer was poured to 1880 mL of methanol to obtain a precipitate. The precipitate thus obtained was taken out by means of filtration. Then the precipitate was dried to obtain targeted resin Z. The obtained resin Z had a viscosity-average molecular weight of 47,100. The repeating units of resin Z is shown below.

[Chemical formula 53]

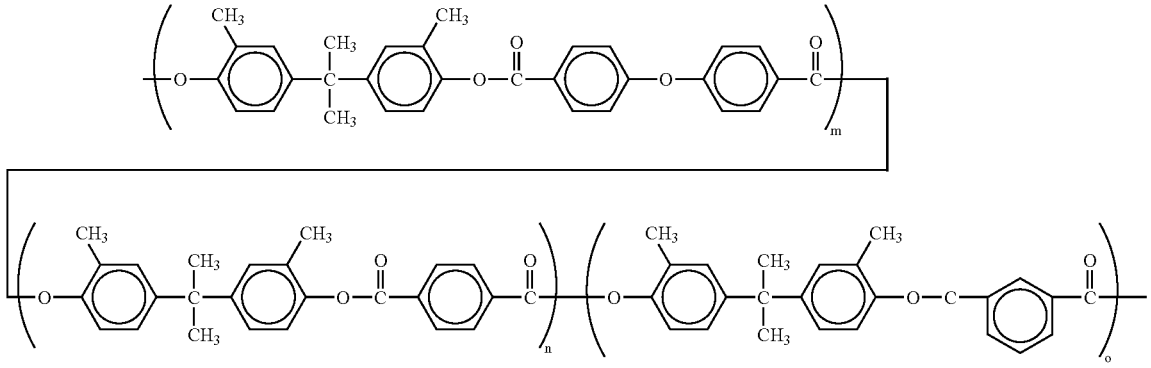

(m:n:o = 5:3:2)

Example of Preparation 31 (Resin Z)

7.20 g of sodium hydroxide and 282 mL of $H_2O$ were weighed out in a 500 mL beaker, and stirred and dissolved. 17.40 g of BP-l was added thereto, followed by stirring and dissolving. Subsequently, this alkaline aqueous solution was transferred to a 1 L reaction tank. 0.1798 g of benzyltriethylammonium chloride and 0.3421 g of 2,3,5-trimethylphenol were then sequentially added to the reaction tank.

The mixed solution of 10.21 g of diphenyl ether 4,4'-dicarboxylic acid dichloride, 4.22 g of terephthaloyl chloride, 2.81 g of isophthaloyl chloride, and 141 mL of dichloromethane was transferred into an addition funnel.

The dichloromethane solution was added dropwise to the alkaline aqueous solution in the reaction tank over a period of 1 hour from the addition funnel, with stirring, while keeping the external temperature of the polymerization tank at 20° C. Stirring was continued for further 4 hours. 235 mL of dichloromethane was then added and stirring was further continued for 8 hours. 2.61 mL of acetic acid was then added, followed by stirring for 30 minutes. Subsequently, stirring was stopped and an organic layer was separated. This organic layer was washed twice with 283 mL of 0.1 N aqueous sodium hydroxide solution, and then washed twice with 283 mL of 0.1 N aqueous hydrochloric acid solution. Furthermore, the organic layer was washed twice with 283 mL of $H_{20}$.

Example of Preparation 32 (Resin ZA)

7.01 g of sodium hydroxide and 282 mL of $H_2O$ were weighed out in a 500 mL beaker, and stirred and dissolved. 17.74 g of BP-m was added thereto, followed by stirring and dissolving. Subsequently, this alkaline aqueous solution was transferred to a 1 L reaction tank. 0.1751 g of benzyltriethylammonium chloride and 0.3330 g of 2,3,5-trimethylphenol were then sequentially added to the reaction tank.

Separately, the mixed solution of 9.94 g of diphenyl ether 4,4'-dicarboxylic acid dichloride, 4.10 g of terephthaloyl chloride, 2.74 g of isophthaloyl chloride, and 141 mL of dichloromethane was transferred into an addition funnel.

The dichloromethane solution was added dropwise the alkaline aqueous solution in the reaction tank over a period of 1 hour from the addition funnel, with stirring, while keeping the external temperature of the polymerization tank at 20° C. Stirring was further continued for 4 hours. 235 mL of dichloromethane was then added and stirring was further continued for 8 hours. 2.54 mL of acetic acid was then added, followed by stirring for 30 minutes. Subsequently, stirring was stopped and an organic layer was separated. This organic layer was washed twice with 283 mL of 0.1 N aqueous sodium hydroxide solution, and then washed twice with 283 mL of 0.1 N aqueous hydrochloric acid solution. Furthermore, the organic layer was washed twice with 283 mL of $H_2O$.

The washed organic layer was poured to 1880 mL of methanol to obtain a precipitate. The precipitate thus obtained was taken out by means of filtration. Then the precipitate was dried to obtain targeted resin ZA. The obtained resin ZA had a viscosity-average molecular weight of 36,200. The repeating units of resin ZA is shown below.

[Chemical formula 54]

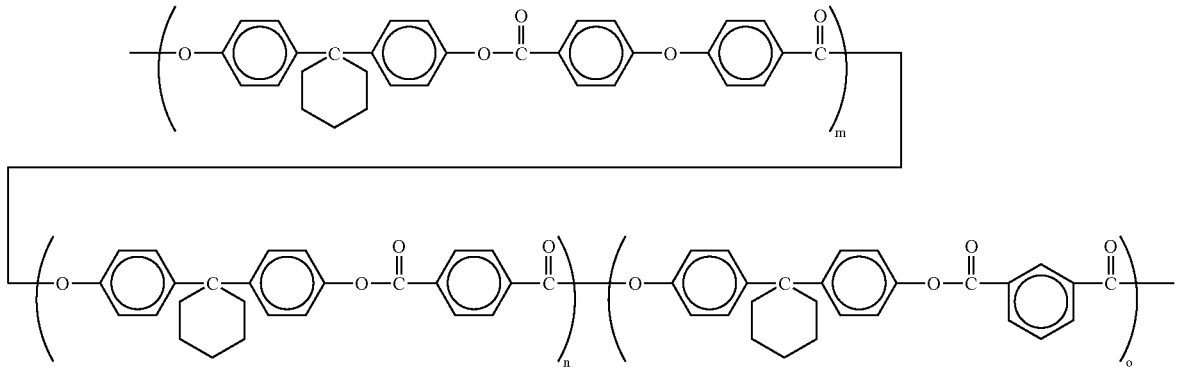

(m:n:o = 5:3:2)

Example of Preparation 33 (Resin ZB)

10.80 g of sodium hydroxide and 423 mL of $H_2O$ were weighed out in a 500 mL beaker, and stirred and dissolved. 26.10 g of BP-l was added thereto, followed by stirring and dissolving. Subsequently, this alkaline aqueous solution was transferred to a 1 L reaction tank. 0.2698 g of benzyltriethylammonium chloride and 0.5131 g of 2,3,5-trimethylphenol were then sequentially added to the reaction tank.

Separately, the mixed solution of 15.32 g of diphenyl ether 4,4'-dicarboxylic acid dichloride, 10.54 g of terephthaloyl chloride, and 211 mL of dichloromethane was transferred into an addition funnel.

The dichloromethane solution was added dropwise the alkaline aqueous solution in the reaction tank over a period of 1 hour from the addition funnel, with stirring, while keeping the external temperature of the polymerization tank at 20° C. Stirring was further continued for 4 hours. 352 mL of dichloromethane was added, followed by stirring for 8 hours. 3.92 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of $H_2O$.

[Chemical formula 55]

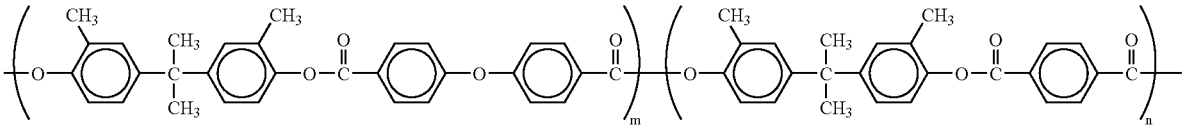

(m:n = 1:1)

The washed organic layer was poured to 2820 mL of methanol to obtain a precipitation. The precipitate thus obtained was taken out by means of filtration. Then the precipitate was dried to obtain targeted resin ZB. The obtained resin ZB had a viscosity average molecular weight of 41,200. The repeating units of resin ZB is shown below.

Example of Preparation 34 (Resin ZC)

10.80 g of sodium hydroxide and 423 mL of $H_2O$ were weighed out in a 500 mL beaker, and stirred and dissolved. 26.10 g of BP-l was added thereto, followed by stirring and dissolving. Subsequently, this alkaline aqueous solution was transferred to a 1 L reaction tank. 0.2698 g of benzyltriethylammonium chloride and 0.5131 g of 2,3,5-trimethylphenol were then sequentially added to the reaction tank.

The mixed solution of 15.32 g of diphenyl ether 4,4'-dicarboxylic acid dichloride, 10.54 g of isophthaloyl chloride, and 211 mL of dichloromethane was separately transferred into an addition funnel.

The dichloromethane solution was added dropwise the alkaline aqueous solution in the reaction tank over a period of 1 hour from the addition funnel, with stirring, while keeping the external temperature of the polymerization tank at 20° C.

Stirring was further continued for 4 hours. 352 mL of dichloromethane was added, followed by further stirring for 8 hours. 3.92 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of $H_2O$.

The washed organic layer was poured to 2820 mL of methanol to obtain a precipitation. The precipitate thus obtained was taken out by means of filtration. Then the precipitate was dried to obtain targeted resin ZC. The obtained resin ZC had a viscosity-average molecular weight of 40,600. The repeating units of resin ZC is shown below.

[Chemical formula 56]

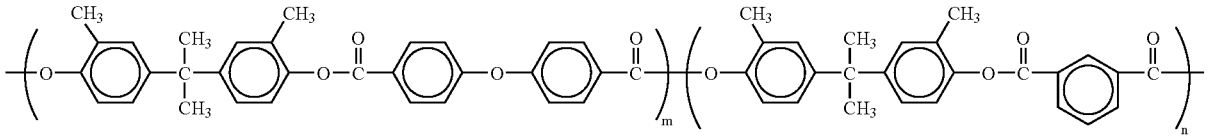

(m:n = 1:1)

Example of Preparation 35 (Resin ZD)

10.50 g of sodium hydroxide and 423 mL of $H_2O$ were weighed out in a 500 mL beaker, and stirred and dissolved. 26.57 g of BP-m was added thereto, followed by stirring and dissolving. Subsequently, this alkaline aqueous solution was transferred to a 1 L reaction tank. 0.2623 g of benzyltriethylammonium chloride and 0.5503 g of p-(tert-butyl)phenol were then sequentially added to the reaction tank.

Separately, the mixed solution of 14.90 g of diphenyl ether 4,4'-dicarboxylic acid dichloride, 10.25 g of terephthaloyl chloride, and 211 mL of dichloromethane was transferred into an addition funnel.

The dichloromethane solution was added dropwise the alkaline aqueous solution in the reaction tank over a period of 1 hour from the addition funnel, with stirring, while keeping the external temperature of the polymerization tank at 20° C. As polymerization progressed, an insoluble element was produced. This made it impossible to take out and purify resin ZD. The following chemical structure shows the repeating units of resin ZD.

Example of Preparation 36 (Resin ZE)

10.50 g of sodium hydroxide and 423 mL of $H_2O$ were weighed out in a 500 mL beaker, and stirred and dissolved. 26.57 g of BP-m was added thereto, followed by stirring and dissolving. Subsequently, this alkaline aqueous solution was transferred to a 1 L reaction tank. 0.2623 g of benzyltriethylammonium chloride and 0.5503 g of p-(tert-butyl)phenol were then sequentially added to the reaction tank.

Separately, the mixed solution of 14.90 g of diphenyl ether 4,4'-dicarboxylic acid dichloride, 10.25 g of isophthaloyl chloride, and 211 mL of dichloromethane was transferred into an addition funnel.

The dichloromethane solution was added dropwise the alkaline aqueous solution in the reaction tank over a period of 1 hour from the addition funnel, with stirring, while keeping the external temperature of the polymerization tank at 20° C. Stirring was further continued for 4 hours. 352 mL of dichloromethane was added, followed by further stirring for 8 hours. 3.81 mL of acetic acid was then added, followed by stirring for 30 minutes. Subsequently, stirring was stopped and an organic layer was separated. This organic layer was washed twice with 424 mL of 0.1 N aqueous sodium hydroxide solution, and then washed twice with 424 mL of 0.1 N aqueous hydrochloric acid solution. Furthermore, the organic layer was washed twice with 424 mL of $H_2O$.

The washed organic layer was poured to 2820 mL of methanol. The precipitate thus obtained was taken out by means of filtration. Then the precipitate was dried to obtain targeted resin ZE. The obtained resin ZE had a viscosity-average molecular weight of 41,100. The repeating units of resin ZE is shown below.

[Chemical formula 57]

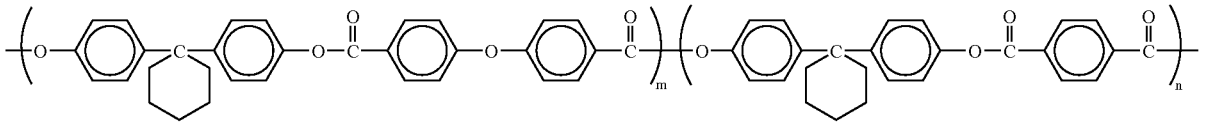

(m:n = 1:1)

[Chemical formula 58]

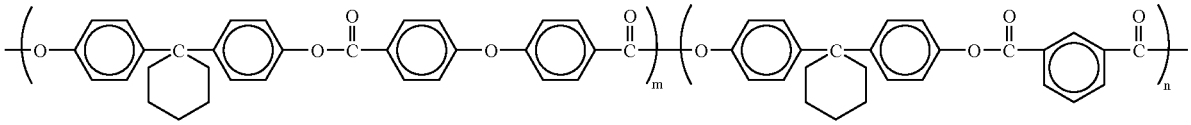

(m:n = 1:1)

Examples 26 and 27, and Comparative Examples 20 to 25

Using resins JA, JB, Z, ZA, ZB, ZC, ZD, and ZE, photosensitive sheets were prepared, and the photosensitive sheets were subjected to an electric characteristic test and a wear test. Table 7 shows the result.

TABLE 7

| | | RESIN | | COMPOSITION (COMPOSITION RATIO:MOLE RATIO) | | PHOTO-SENSITIVE | ELECTRIC CHARACTERISTIC VL | | WEAR TEST |
|---|---|---|---|---|---|---|---|---|---|
| | | | | BIVALENT PHENOL | DICARBOXYLIC ACID | | | LL ENVIRONMENT | |
| | | KIND | Mv | RESIDUE | RESIDUE | SHEET | NN (−V) | (−V) | WEAR (mg) |
| EXAMPLE | 26 | JA | 41,000 | BP-g(1) | ODBA(1) | JA1 | 56 | 99 | 0.1 |
| | 27 | JB | 31,500 | BP-g(1) | ODBA(1) | JB1 | 75 | 117 | 0.9 |
| COMPARATIVE | 20 | Z | 47,100 | BP-l(10) | ODBA(5)/TPA(3)/IPA(2) | Z1 | 72 | 122 | 1.0 |
| EXAMPLE | 21 | ZA | 36,200 | BP-m(10) | ODBA(5)/TPA(3)/IPA(2) | ZA1 | 100 | 150 | 2.2 |
| | 22 | ZB | 41,200 | BP-l(2) | ODBA(1)/TPA(1) | ZB1 | 108 | 145 | 1.0 |
| | 23 | ZC | 40,600 | BP-l(2) | ODBA(1)/TPA(1) | ZC1 | 65 | 112 | 1.1 |
| | 24 | ZD | — | BP-m(2) | ODBA(1)/TPA(1) | ZD1 | INSOLUBLE | INSOLUBLE | INSOLUBLE |
| | 25 | ZE | 41,100 | BP-m(2) | ODBA(1)/TPA(1) | ZE1 | 86 | 142 | 1.9 |

It can be found from the results shown in Table 7 that the photosensitive sheets JA1 and JB1 incur little wear, and have good electric characteristics in the electric characteristic test and the wear test.

Note that, the present application is based on the Japanese Application (Patent Application No. 2004-210571) filed on Jul. 16, 2004, and is incorporated by citation.

DESCRIPTION OF REFERENCE NUMERALS AND SIGNS

Figure 1:
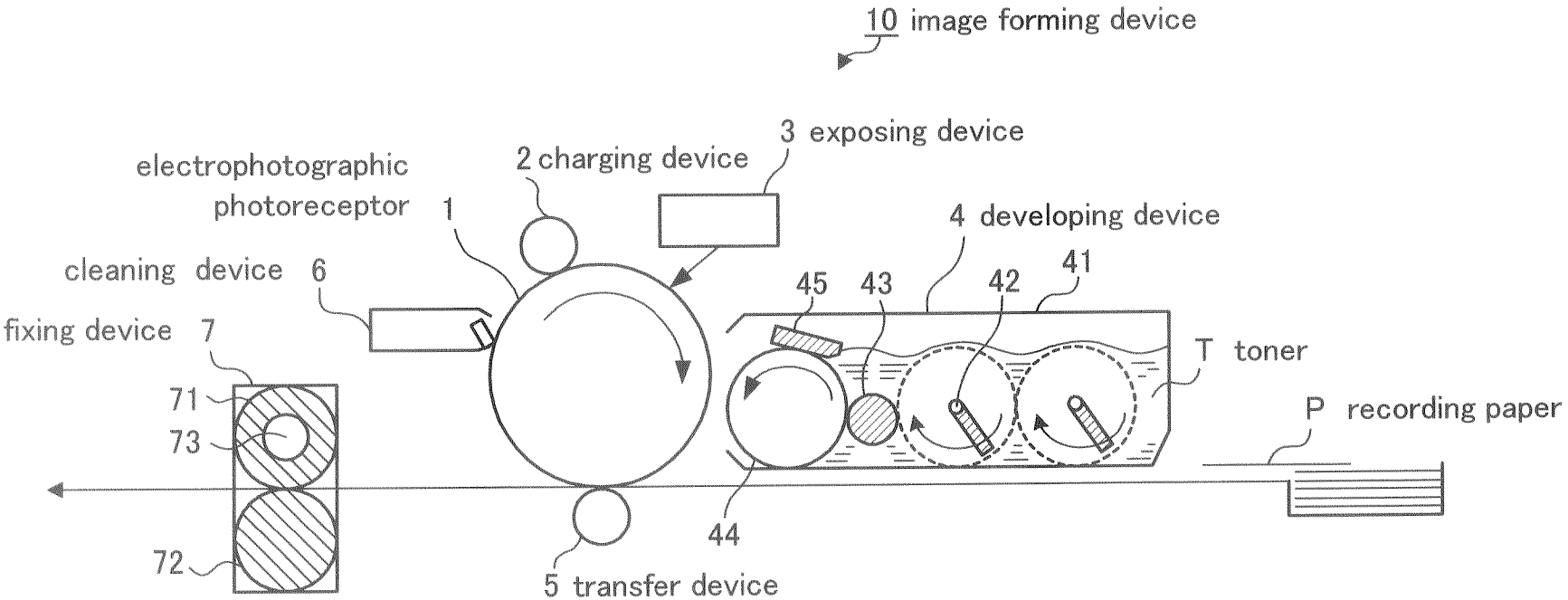
FIG. 1 is a view for explaining an image forming device.

1 . . . electrophotographic photoreceptor, 2 . . . charging device (charging roller), 3 . . . exposing device, 4 . . . developing device, 5 . . . transfer device, 6 . . . cleaning device, 7 . . . fixing device, 41 . . . developing tank, 42 . . . agitators, 43 . . . supplying roller, 44 . . . developing roller, 45 . . . restricting member, 71 . . . upper fixing member (fixing roller), 72 . . . lower fixing member (fixing roller), 73 . . . heating device

The invention claimed is:

1. An electrophotographic photoreceptor comprising:

an electroconductive substrate; and a photosensitive layer provided on the electroconductive substrate;

wherein the photosensitive layer comprises an organic pigment and a polyester resin containing the repeating unit represented by the following formula 5:

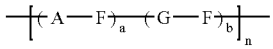

(5)

wherein a ratio of a/(a+b) is greater than 0.7,

A is a compound having a structure represented by the following formula (A)

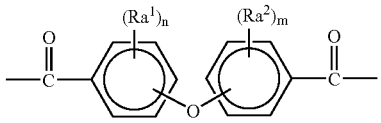

(A)

wherein each of $Ra^1$ and $Ra^2$ independently represents a hydrogen atom or a monovalent substituent which may have a substituent, and each of n and m is independently an integer from 0 to 4, F is a compound having a structure represented by the following formula (F):

(F)

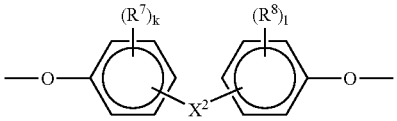

wherein $X^2$ represents one selected from the group consisting of a single bond and a bivalent group, and said bivalent group is one selected from the group consisting of a sulfur atom, an oxygen atom, a sulfonyl group, a cycloalkylene group, and —$CR^{19}R^{20}$—, each of $R^7$ and $R^8$ independently represents one selected from the group consisting of a hydrogen atom, an alkyl group, an aryl group, a halogen group, and an alkoxy group, and each of k and l independently represents an integer from 1 to 4, wherein each of $R^{19}$ and $R^{20}$ independently represents one selected from the group consisting of a hydrogen atom, an alkyl group, an aryl group, a halogen and an alkoxy group, G is a compound having a structure represented by the following formula (G.):

(G)

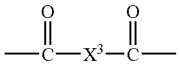

wherein $X^3$ represents a bivalent group.

2. The electrophotographic photoreceptor according to claim 1, wherein the organic pigment is at least one selected from the group consisting of a phthalocyanine pigment, an azo pigment, a quinacridone pigment, an indigo pigment, a perylene pigment, a polycyclic quinone pigment, an anthraquinone pigment and a benzimidazole pigment.

3. The electrophotographic photoreceptor according to claim 2, wherein the organic pigment is a phthalocyanine or an azo pigment.

4. The electrophotographic photoreceptor according to claim 1, wherein F in formula 5 is a compound having a structure represented by any one of the following formulae (B) to (E):

(B)

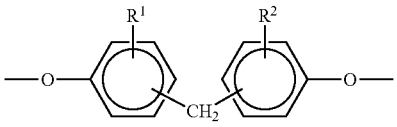

wherein each of $R^1$ and $R^2$ independently represents one selected from the group consisting of a hydrogen atom, an alkyl group, an aryl group, a halogen group, and an alkoxy group, (C)

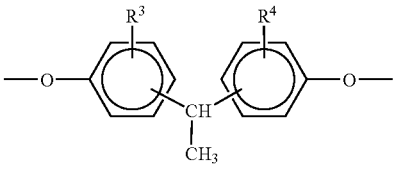

wherein each of $R^3$ and $R^4$ independently represents one selected from the group consisting of a hydrogen atom, an alkyl group, an aryl group, a halogen group, and an alkoxy group, (D)

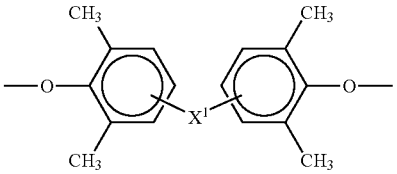

wherein $X^1$ represents one selected from the group consisting of a single bond and a bivalent group, (E)

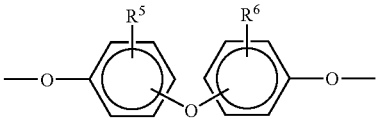

wherein each of $R^5$ and $R^6$ independently represents one selected from the group consisting of a hydrogen atom, an alkyl group, an aryl group, a halogen group, and an alkoxy group.

5. The electrophotographic photoreceptor according to claim 1, wherein

A in the formula 5 is a diphenyl ether dicarboxylic acid.

6. The electrophotographic photoreceptor according to claim 1, wherein

A in the formula 5 is selected from the group consisting of diphenyl ether 2,2'-dicarboxylic acid, diphenyl ether 2,4'-dicarboxylic acid, and diphenyl ether 4,4'-dicarboxylic acid.

7. The electrophotographic photoreceptor according to claim 1, wherein

A in the formula 5 is diphenyl ether 4,4'-dicarboxylic acid.

8. The electrophotographic photoreceptor according to claim 1, wherein

G in formula 5 is an aromatic dicarboxylic acid.

9. The electrophotographic photoreceptor according to claim 1, wherein

G in formula 5 is selected from the group consisting of isophthalic acid and terephthalic acid.

10. The electrophotographic photoreceptor according to claim 1, wherein the photosensitive layer further comprises a compound represented by the following general formula 6

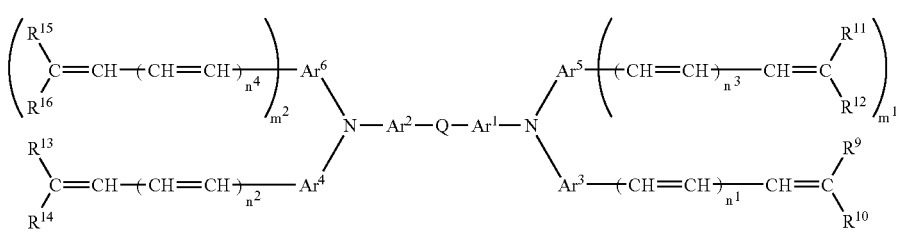

(6)

wherein, each of $Ar^1$ to $Ar^6$ independently represents one selected from the group consisting of an arylene group which may have a substituent, and a bivalent heterocyclic group which may have a substituent;

each of $m^1$ and $m^2$ independently represents 0 or 1;

Q represents one selected from the group consisting of a direct bond and a bivalent residue;

each of $R^9$ to $R^{16}$ independently represents one selected from the group consisting of a hydrogen atom, an alkyl group which may have a substituent, an aryl group which may have a substituent, and a heterocyclic group which may a substituent; each of $n^1$ to $n^4$ represents independently an integer from 0 to 4; and $Ar^1$ to $Ar^6$ may bond with each other to form a cyclic structure.

11. The electrophotographic photoreceptor according to claim 1, wherein the polyester resin has a viscosity-average molecular weight (Mv) of 10,000 to 300,000.

12. A photoreceptor cartridge to be attached to an image forming device, the photoreceptor cartridge comprising:

the electrophotographic photoreceptor as set forth in claim 1; and at least one device selected from the group consisting of a charging device for charging the electrophotographic photoreceptor at a predetermined potential, a developing device for supplying toner on a surface of the electrophotographic photoreceptor, and a cleaning device for scraping off and collecting residual toner adhered on the surface of the electrophotographic photoreceptor.

13. An image forming device comprising:

the electrophotographic photoreceptor as set forth in claim 1;

a charging device for charging the electrophotographic photoreceptor;

an exposing device for forming an electrostatic latent image on a photosensitive surface of the electrophotographic photoreceptor;

a developing device for supplying toner on a surface of the electrophotographic photoreceptor;

a transporting device for transferring a toner image formed on the electrophotographic photoreceptor onto a sheet of recording paper; and a fixing device for fixing the toner image transferred onto the recording paper.

* * * * *